US006558232B1

(12) United States Patent
Kajiwara et al.

(10) Patent No.: US 6,558,232 B1
(45) Date of Patent: May 6, 2003

(54) SYSTEM AND METHOD FOR CMP HAVING MULTI-PRESSURE ZONE LOADING FOR IMPROVED EDGE AND ANNULAR ZONE MATERIAL REMOVAL CONTROL

(75) Inventors: Jiro Kajiwara, Cupertino, CA (US); Gerard S. Moloney, Milpitas, CA (US); Huey-Ming Wang, Fremont, CA (US); David A. Hansen, Palo Alto, CA (US); Alejandro Reyes, San Jose, CA (US)

(73) Assignee: Multi-Planar Technologies, Inc., San Jose, CA (US)

( * ) Notice: Subject to any disclaimer, the term of this patent is extended or adjusted under 35 U.S.C. 154(b) by 0 days.

(21) Appl. No.: 09/570,369

(22) Filed: May 12, 2000

(51) Int. Cl.[7] ..... B24B 29/00
(52) U.S. Cl. ..... 451/41; 451/288
(58) Field of Search ..... 451/41, 282–288, 451/398, 59, 63, 289, 290

(56) References Cited

U.S. PATENT DOCUMENTS

| | | | | |
|---|---|---|---|---|
| 5,584,751 A | | 12/1996 | Kobayashi et al. | 451/288 |
| 5,635,083 A | | 6/1997 | Breivogel et al. | 216/88 |
| 5,762,539 A | * | 6/1998 | Nakashiba et al. | 451/285 |
| 5,803,799 A | * | 9/1998 | Volodarsky et al. | 451/288 |

(List continued on next page.)

FOREIGN PATENT DOCUMENTS

| | | | | |
|---|---|---|---|---|
| EP | 0 747 167 A | | 12/1996 | |
| EP | 0 744 323 A2 | * | 5/1997 | B24B/37/04 |
| EP | 0 774 323 A2 | | 5/1997 | |
| EP | 0 841 123 A | | 5/1998 | |
| EP | 0 868 975 A1 | | 10/1998 | |
| EP | 0 881 039 A | | 12/1998 | |
| FR | 2 778 129 A1 | | 5/1998 | |
| FR | 2 778 129 A1 | * | 5/1999 | B24D/9/08 |
| WO | WO 99/62672 A1 | | 12/1999 | |

*Primary Examiner*—Joseph J. Hail, III
*Assistant Examiner*—David B. Thomas
(74) *Attorney, Agent, or Firm*—Dorsey & Whitney LLP; R. Michael Ananian

(57) ABSTRACT

In one aspect, the invention provides a method for planarizing a circular disc-type semiconductor wafer or other substrate. The method includes the steps of pressing a retaining ring surrounding the wafer against a polishing pad at a first pressure; pressing a first peripheral edge portion of the wafer against the polishing pad with a second pressure; and pressing a second portion of the wafer interior to the peripheral edge portion against the polishing pad with a third pressure. The second pressure may be provided through a mechanical member in contact with the peripheral edge portion; and the second pressure may be a pneumatic pressure against a backside surface of the wafer. Desirably, the pneumatic pressure is exerted through a resilient membrane, or is exerted by gas pressing directly against at least a portion of the wafer backside surface. A carrier or subcarrier for a CMP apparatus that includes: a plate having an outer surface; a first pressure chamber for exerting a force to urge the plate in a predetermined direction; a spacer coupled to a peripheral outer edge of the plate; a membrane coupled to the plate via the spacer and separated from the plate by a thickness of the spacer; and a second pressure chamber defined between the membrane and the plate surface for exerting a second force to urge the membrane in a third predetermined direction. Substrate, such as a semiconductor wafer, processed or fabricated according to the invention.

27 Claims, 21 Drawing Sheets

U.S. PATENT DOCUMENTS 5,916,016 A * 6/1999 Bothra ..... 451/289
5,964,653 A * 10/1999 Perlov et al. ..... 451/288
5,980,361 A * 11/1999 Muller et al. ..... 451/288
6,056,632 A * 5/2000 Mitchel et al. ..... 451/288
6,093,089 A * 7/2000 Chen et al. ..... 451/288
6,106,378 A * 8/2000 Perlov et al. ..... 451/288
6,106,379 A * 8/2000 Mosca ..... 451/288
6,113,479 A * 9/2000 Sinclair et al. ..... 451/288
6,132,298 A * 10/2000 Zuniga et al. ..... 451/288
6,196,905 B1 * 3/2001 Inaba ..... 451/288
6,203,414 B1 * 3/2001 Numoto et al. ..... 451/288
6,241,593 B1 * 6/2001 Chen et al. ..... 451/288
6,244,942 B1 * 6/2001 Zuniga ..... 451/288
6,270,397 B1 * 8/2001 Wu ..... 451/288
6,273,803 B1 * 8/2001 Wang et al. ..... 451/288
6,273,804 B1 * 8/2001 Numoto ..... 451/288
6,277,009 B1 * 8/2001 Chen et al. ..... 451/288
6,277,010 B1 * 8/2001 Perlov et al. ..... 451/288
6,280,306 B1 * 8/2001 Hosoki et al. ..... 451/288
6,283,834 B1 * 9/2001 Liauzu ..... 451/285
6,390,905 B1 * 5/2002 Korovin et al. ..... 451/286

* cited by examiner

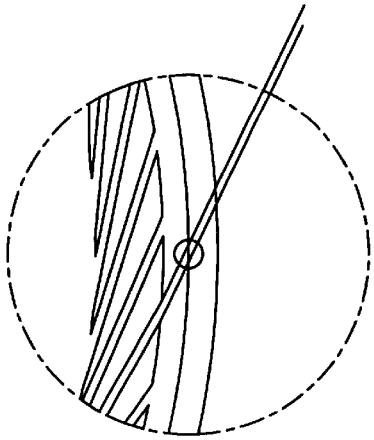
FIG. 12C
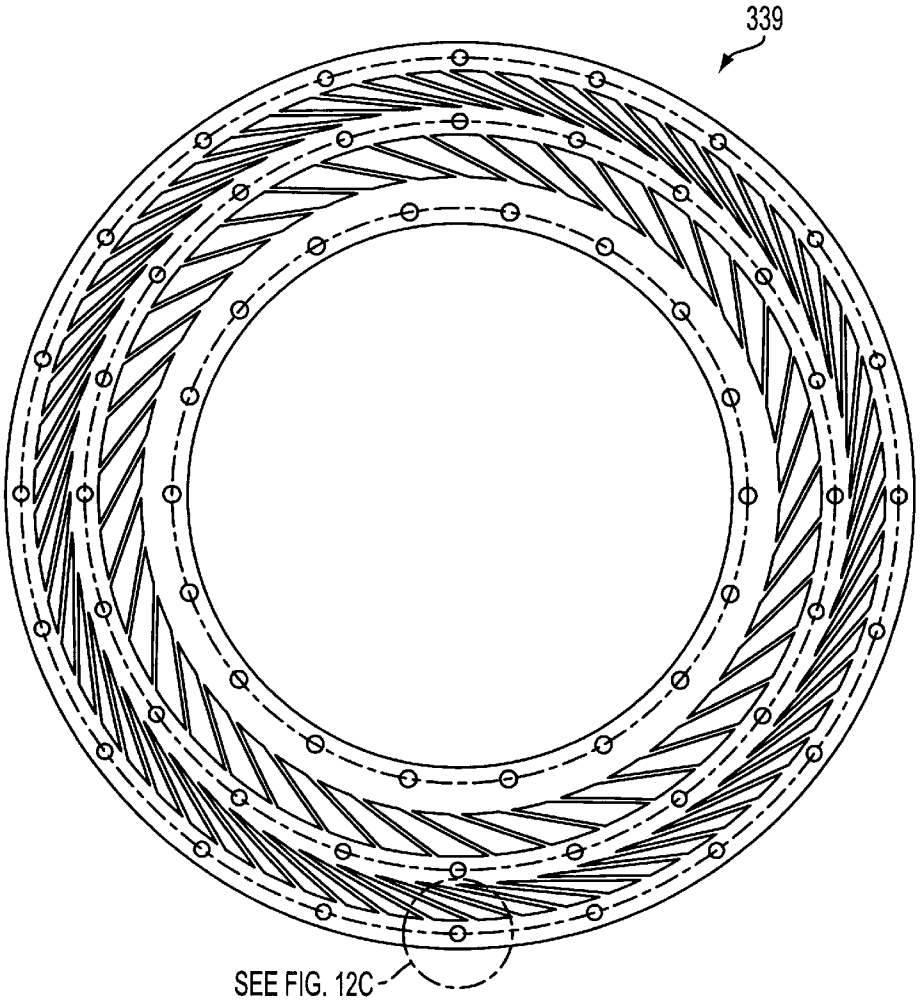
FIG. 12A
FIG. 12B

SYSTEM AND METHOD FOR CMP HAVING MULTI-PRESSURE ZONE LOADING FOR IMPROVED EDGE AND ANNULAR ZONE MATERIAL REMOVAL CONTROL

RELATED APPLICATIONS

This application is related to U.S patent application Ser. No. 09/570,370, filed May 12, 2000 and entitled System and Method for Pneumatic diapharagm CMP Head Having Separate Retaining Ring and Multi-Region Wafer Pressure Control; which is hereby incorporated by reference.

FIELD OF THE INVENTION

This invention pertains generally to systems, devices, and methods for polishing and planarizing semiconductor wafers, and more particularly to systems, devices, and methods utilizing multiple planarization pressure zones to achieving high-planarization uniformity across the surface of a semiconductor wafer.

BACKGROUND OF THE INVENTION

As feature size decreases, density increases, and the size of the semiconductor wafer increase, Chemical Mechanical Planarization (CMP) process requirements become more stringent. Wafer to wafer process uniformity as well as intra-wafer planarization uniformity are important issues from the standpoint of producing semiconductor products at a low cost. As the size of dies increases a flaw in one small area increasing results in rejection of a relatively large circuit so that even small flaws have relatively large economic consequences in the semiconductor industry.

Many reasons are known in the art to contribute to uniformity problems. These include the manner in which wafer backside pressure is applied to the wafer during planarization, edge effect non-uniformities arising from the typically different interaction between the polishing pad at the edge of the wafer as compared to at the central region, and to non-uniform deposition of metal and/or oxide layers to might desirably be compensated for by adjusting the material removal profile during planarization. Efforts to simultaneously solve these problems have not heretofore been completely successful.

With respect to the nature of the wafer backside polishing pressure, hard backed heads were typically used. In many conventional machines, an insert is provided between the carrier (or subcarrier) surface and the wafer or other substrate to be polished or planarized in an attempt to provide some softness in an otherwise hard backed system. This insert is frequently referred to as the wafer insert. These inserts are problematic because they frequently result in process variation leading to substrate-to-substrate variation. This variation is not constant or generally deterministic. One element of the variation is the amount of water absorbed by the insert during a period of use and over its lifetime. Some process uniformity improvement may be achieved by initially soaking the insert in water prior to use. This tends to make the initial period of use more like the later period of use, however, unacceptable processes variations are still observed. These process variations may be controlled to a limited extend by preconditioning the insert with water as described and by replacing the insert before its characteristics change beyond acceptable limits.

Use of the insert has also required fine control of the entire surface to which the insert was adhered as any non-uniformity, imperfection, or deviation from planarity or parallelism of the subcarrier surface would typically be manifested as planarization variations across the substrate surface. For example, in conventional heads, an aluminum or ceramic plate would be fabricated, then lapped and polished before installation in the head. Such fabrication increases the costs of the head and of the machine, particularly if multiple heads are provided.

As the size of structures (feature size) on the semiconductor wafer surface have been reduced to smaller and smaller sizes, now typically about 0.2 microns, the problems associated with non-uniform planarization have increased. This problem is sometimes referred to as a Within Wafer Non-Uniformity (WIWNU) problem.

When so called hard backed planarization heads, that is heads that press the backside of the semiconductor wafer with a hard surface, the front surface of the wafer may not conform to the surface of the polishing pad and planarization non-uniformities may typically result. Such hard backed head designs generally utilize a relatively high polishing pressure (for example, pressure in the range between about 6 psi and about 8 psi) are used, and such relatively high pressures effectively deform the wafer to match the surface conformation of the polishing pad. When such wafer surface distortion occurs, the high spots are polished at the same time as the low spots give some degree of global uniformity but actually producing a bad planarization result. That is too much material from traces in some areas of the wafer will be removed and too little material from others. When the amount of material removed is excessive, those die or chips will not be useable.

On the other hand, when a soft backed head is used, the wafer is pressed against the polishing pad but as the membrane or other soft material does not tend to cause distortion of the wafer, lower polishing pressures may be employed, and conformity of the wafer front surface is achieved without distortion so that both some measure of global polishing uniformity and good planarization may be achieved. Better planarization uniformity is achieved at least in part because the polishing rate on similar features from die to die on the wafer is the same.

While some attempts have been made to utilize soft backed CMP heads, they have not been entirely satisfactory. In some head designs, there have been attempts to use a layer of pressurized air over the entire surface of the wafer to press the wafer during planarization. Unfortunately, while such approaches may provides a soft backed head it does not permit independent adjustment of the pressure at the edge of the wafer and at more central regions to solve the wafer edge non-uniformity problems.

With respect to correction or compensation for edge polishing effects, attempts have been made to adjust the shape of the retaining ring and to modify a retaining ring pressure so that the amount of material removed from the wafer near the retaining ring was modified. Typically, more material is removed from the edge of the wafer, that is the wafer edge is over polished. In order to correct this over polishing, usually, the retaining ring pressure is adjusted to be somewhat lower than the wafer backside pressure so that the polishing pad in that area was somewhat compressed by the retaining ring and less material was removed from the wafer within a few millimeters of the retaining ring. However, even these attempts were not entirely satisfactory as the planarization pressure at the outer peripheral edge of the wafer was only indirectly adjustable based on the retaining ring pressure. It was not possible to extend the effective distance of a retaining ring compensation effect an arbitrary distance into the wafer edge. Neither was it possible to independently adjust the retaining ring pressure, edge pressure, or overall backside wafer pressure to achieve a desired result.

With respect to the desirability to adjust the material removal profile to adjust for incoming wafer non-uniform depositions, few if any attempts to provide such compensation have been made.

Therefore, there remains a need for a soft backed CMP head that provides excellent planarization, controls edge planarization effects, and permits adjustment the wafer material removal profile to compensate for non-uniform deposition of the structural layers on the wafer semiconductor substrate.

SUMMARY

The invention provides a polishing head and a polishing apparatus, machine, or tool (CMP tool) for polishing or planarizing a surface of a substrate or other work piece, such as a semiconductor wafer. The apparatus includes a rotatable polishing pad, and a wafer subcarrier which itself includes a wafer or substrate receiving portion to receive the substrate and to position the substrate against the polishing pad; and a wafer pressing member including a having a first pressing member and a second pressing member, the first pressing member applying a first loading pressure at an edge portion of the wafer against the polishing pad, and the second pressing member applying a second loading pressure a central portion of the wafer against the pad, wherein the first and second loading pressures are different. Although this wafer subcarrier and wafer pressing member may be used separately, in a preferred embodiment of the invention, the polishing apparatus further includes a retaining ring circumscribing the wafer subcarrier; and a retaining ring pressing member applying a third loading pressure at the retaining ring against the polishing pad. The first, second, and third loading pressures are independently adjustable.

In another aspect, the invention provides a method for planarizing a circular disc-type semiconductor wafer or other substrate. The method includes the steps of pressing a retaining ring surrounding the wafer against a polishing pad at a first pressure; pressing a first peripheral edge portion of the wafer against the polishing pad with a second pressure; and pressing a second portion of the wafer interior to the peripheral edge portion against the polishing pad with a third pressure. In another aspect, the second pressure may be provided through a mechanical member in contact with the peripheral edge portion; and the second pressure is a pneumatic pressure against a backside surface of the wafer. Desirably, the pneumatic pressure is exerted through a resilient membrane, or is exerted by gas pressing directly against at least a portion of the wafer backside surface.

In another aspect, the invention also provides a a subcarrier for a CMP apparatus that includes: a plate having an outer surface; a first pressure chamber for exerting a force to urge the plate in a predetermined direction; a spacer coupled to a peripheral outer edge of the plate; a membrane coupled to the plate via the spacer and separated from the plate by a thickness of the spacer; and a second pressure chamber defined between the membrane and the plate surface for exerting a second force to urge the membrane in a third predetermined direction.

In yet another aspect, the invention provides a carrier for a substrate polishing apparatus including: a housing; a retaining ring flexibly coupled to the housing; a first pressure chamber for exerting a first force to urge the retaining ring in a first predetermined direction relative to the housing; a subcarrier plate having an outer surface and flexibly coupled to the housing; a second pressure chamber for exerting a second force to urge the subcarrier plate in a second predetermined direction relative to the housing; the retaining ring circumscribing a portion of the subcarrier plate and defining a circular recess; a spacer coupled to a peripheral outer edge of the subcarrier plate outer surface within the retaining ring circular recess; a membrane coupled to the subcarrier plate via the spacer and disposed within the circular recess, the membrane separated from the subcarrier plate outer surface by a thickness of the spacer; and a third pressure chamber defined between the membrane and the outer subcarrier plate surface for exerting a third force to urge the membrane in a third predetermined direction relative to the housing.

The invention further includes a substrate, such as a semiconductor wafer, processed or fabricated according to the inventive method.

BRIEF DESCRIPTION OF THE DRAWINGS

FIG. 3 is a diagrammatic illustration showing an embodiment of soft-backed CMP head having a membrane with a sealed pressure chamber, wherein

FIG. 12 is a diagrammatic illustration showing an embodiment of and alternative torque transfer member that may be used in the embodiment of FIG. 10.

DETAILED DESCRIPTION OF EMBODIMENTS OF THE INVENTION

Figure 1:
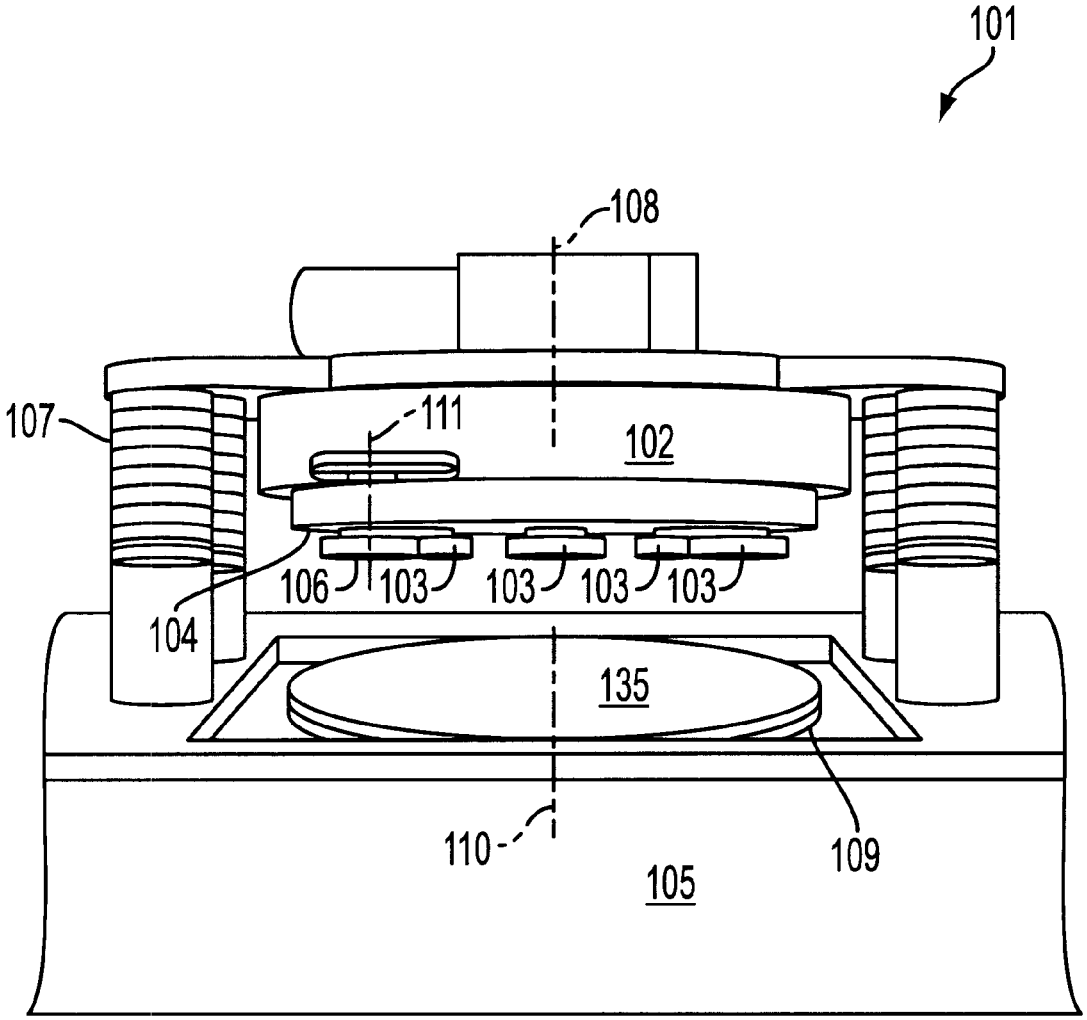
FIG. 1 is a diagrammatic illustration showing an exemplary multi-head CMP polishing or planarization machine.

The inventive structure and method are now described in the context of specific exemplary embodiments illustrated in the figures. The inventive structure and method eliminate many of the problems associated with conventional head designs using polymeric insert between the backside of the wafer and the surface of the wafer subcarrier as well as problems associated with pressure distribution over the surface of the wafer for soft-backed heads. The different forces or pressures impart different loading of the front side surface of the wafer against the polishing pad resulting in a different rate of removal. The pressure applied to a retaining ring similarly alters the loading force of the retaining ring contact surface against the retaining ring and influences material removal at the edge of the wafer. The inventive structure and method replace the insert with a flexible film or membrane adjacent the back side surface of the wafer. In one embodiment, this membrane forms a sealed enclosure, while in a second embodiment, the membrane has an opening or orifice such that pressure is applied at least in part directly against the backside wafer surface. The use of this backside soft surface pressure chamber or alternatively direct pressure against the wafer backside surface along with other elements of the inventive head also permit polishing at a lower pressure thereby achieving greater within wafer uniformity. The closed chamber embodiment and the open orifice embodiment are described in greater detail hereinafter.

The inventive head also provides separate control of the amount of material removed from the edge of the wafer as compared to the amount of material removed near the center of the wafer, thereby allowing control over a edge uniformity. This control is achieved in part by providing a head having three separate substantially independent pressure controls: (i) a backside wafer pressure exerted against the central portion of the wafer, (ii) a subcarrier pressure exerted against the peripheral edge of the backside of the wafer, and (iii) a retaining ring pressure exerted directly against the polishing pad in an annular region circumscribing the wafer.

In the structure to be described, the retaining ring is supported from the housing via a flexible material so that it may move vertically with little friction and no binding. Some tolerance between adjacent mechanical components is provided so that the retaining ring is able to float on the polishing pad surface in a manner that accommodates minor angular variations during the polishing or planarization operation. The subcarrier is likewise suspended from the housing by a flexible material so that it to may move vertically with little friction and no binding. As with the retaining ring, small mechanical tolerances are provided between adjacent mechanical elements so that the subcarrier is able to float on the polishing pad surface in a manner that accommodates minor angular variations during the polishing or planarization operation. The wafer contacts the subcarrier through a firm connection only approximate the peripheral edge all the wafer. The central portion of the wafer interior to the annular peripheral wafer a edge contacts the subcarrier only through a flexible film or membrane and cushioning volume of a air or other pneumatic or hydraulic pressure during the polishing or planarization operation. In addition to the suspension of the retaining ring and subcarrier from the head housing, the housing itself is attached to or suspended from other elements of the planarization machine. Usually this attachment or suspension is provided by a pneumatic, mechanical, or hydraulic movement means. For example, a pneumatic cylinder provides the movement, as is known in the art. This attachment permits the head as a whole to be moved vertically upward and downward relative to the surface of the polishing pad so that the wafer may be placed on the subcarrier prior to polishing and removed for on the subcarrier at the completion of polishing. Robotic devices are typically used for this purpose.

In one embodiment of the invention, the head the lifting and lowering mechanism is provided with a hard physical stop down which is adjustable compensates for polishing pad wear and for retaining ring wear. Compensating for pad wear and/or for retaining ring wear by adjusting the location of the head as a whole relative to the pad, rather than utilizing any of the vertical range of movement or stroke of the subcarrier or of the retaining ring relative to the housing, is preferable as it maintains the retaining ring and subcarrier at or near the center of its range of movement thereby minimizing the likelihood of undesired mechanical effects on the operation of the head and increasing or stabilizing process uniformity. Such mechanical effects may for example include, an increase or decrease in the area of sliding surfaces and their associated friction, changes in the characteristics of the flexible couplings between the housing and the retaining ring or between the housing and the subcarrier, as well as other mechanical effects caused for example by imperfect assembly or alignment. In essence, by always positioning the head assembly so that critical operational elements within the head (such as, the retaining ring, the subcarrier, and the backside membrane) are operated at or near a predetermined position, any secondary effects that might influence the process are reduced.

Providing this measure of control over the head assembly relative to the polishing pad also permits longer use of the polishing pad of any particular thickness, and the use of thicker pads initially anticipating a longer useful lifetime for such thicker polishing pad. Of course, in some situations pad reconditioning may be required for such thicker polishing pads after a predetermined number of wafers have been polished or based on the then current properties of the polishing pad.

Typically adjustment of the few millimeters is sufficient to accommodate for polishing pad and retaining ring wear. For example, the ability to just in the range from about 1 mm to about 20 mm is usually sufficient, were typically the ability to just head position in the range from about 2 mm to about 8 mm is sufficient adjustment. These adjustments can be made via an adjustment nut or screw, an adjustment via a pneumatic or hydraulic actuator using a change of pressure, via a rack and pinion gear assembly, via a ratchet mechanism, or via other mechanical adjustment means as are known in the art. alternatively, position encoders may be utilized to detect a head lower stop position, which when reached is held by a clamp or other means. While some electronic control might be utilized to maintain a detected stop position, such electronic controls are not preferred as they may be susceptible to noise and jitter in mechanical position which would construct precise planarization of the semiconductor wafer or other substrate.

The inventive CMP head structure and planarization methodology may be utilized with a CMP machine having a single head or alternatively having a plurality of heads, such as for example may be provided in conjunction with a carousel assembly. Furthermore, the inventive head may be utilized in all manner of CMP machine's including machines utilizing and orbital motion polishing component, a circular motion polishing component, a linear or reciprocating motion polishing component, and combinations of these polishing motions, as well as in or with other CMP and polishing machines as are known in the art.

In FIG. 1, there is shown a chemical mechanical polishing or planarization (CMP) tool 101, that includes a carousel 102 carrying a plurality of polishing head assemblies 103 comprised of a head mounting assembly 104 and the substrate (wafer) carrier assembly 106. We use the term "polishing" here to mean either polishing of a substrate 113 generally including semiconductor wafer 113 substrates, and also to planarization when the substrate is a semiconductor wafer onto which electronic circuit elements have been deposited. Semiconductor wafers are typically thin and somewhat brittle disks having diameters nominally between 100 mm and 300 mm. Currently 100 mm, 200 mm, and 300 semiconductor wafers are used in the industry. The inventive design is applicable to semiconductor wafers and other substrates at least up to 300 mm diameter as well as to larger diameter substrates, and advantageously confines any significant wafer surface polishing nonuniformities to no more than about the so-called exclusion zone at the radial periphery of the semiconductor disc. Typically this exclusion zone is from about 1 mm to about 5 mm, more usually about 2 mm to about 3 mm.

A base 105 provides support for the other components including a bridge 107 which supports and permits raising and lowering of the carousel with attached head assemblies. Head mounting assembly 104 is installed on carousel 102, and each of the polishing head assemblies 103 are mounted to head mounting assembly 104 for rotation, the carousel is mounted for rotation about a central carousel axis 108 and each polishing head assembly 103 axis of rotation 111 is substantially parallel to, but separated from, the carousel axes of rotation 108. CMP tool or machine 101 also includes the motor driven platen 109 mounted for rotation about a platen drive axes 110. Platen 109 holds a polishing pad 135 and is driven to rotate by a platen motor (not shown). This particular embodiment of a CMP tool is a multi-head design, meaning that there are a plurality of polishing heads for each carousel; however, single head CMP tools are known, and inventive CMP head and method for polishing may be used with either a multi-head or single-head type polishing apparatus.

Furthermore, in this particular CMP design, each of the plurality of heads are driven by a single head motor which drives a chain (not shown), which in turn drives each of the polishing heads 103 via a chain and sprocket mechanism; however, the invention may be used in embodiments in which each head 103 is rotated with a separate motor and/or by other than chain and sprocket type drives. The inventive CMP tool also incorporates a rotary union providing a plurality of different gas/fluid channels to communicate pressurized fluids such as air, water, vacuum, or the like between stationary sources external to the head and locations on or within the head. In one embodiment, five different gas/fluid channels are provided by the rotary union. In embodiments of the invention in which the chambered subcarrier is incorporated, additional rotary union ports are included to provide the required pressurized fluids to the additional chambers.

In operation, the polishing platen 109 with adhered polishing pad 135 rotates, the carousel 102 rotates, and each of the heads 103 rotates about their own axis. In one embodiment of the inventive CMP tool, the carousel axis of rotation 108 is off-set from the platen axis of rotation 110 by about one inch; however, this is not required or even desired in all situations. In one embodiment, the speed at which each component rotates is selected such that each portion on the wafer travels substantially the same distance at the same average speed as every other point on a wafer so as to provide for uniform polishing or planarization of the substrate. As the polishing pad is typically somewhat compressible, the velocity and manner of the interaction between the pad and the wafer where the wafer first contacts the pad is a significant determinant of the amount of material removed from the edge of the wafer, and of the uniformity of the polished wafer surface.

A polishing tool having a plurality of carousel mounted head assemblies is described in U.S. Pat. No. 4,918,870 entitled *Floating Subcarriers for Wafer Polishing Apparatus*; a polishing tool having a floating head and floating retainer ring is described in U.S. Pat. No. 5,205,082 *Wafer Polisher head Having Floating Retainer Ring*; and a rotary union for use in a polisher head is described in U.S. Pat. No. 5,443,416 and entitled *Rotary Union for Coupling Fluids in a Wafer Polishing Apparatus*; each of which are hereby incorporated by reference.

Figure 2:
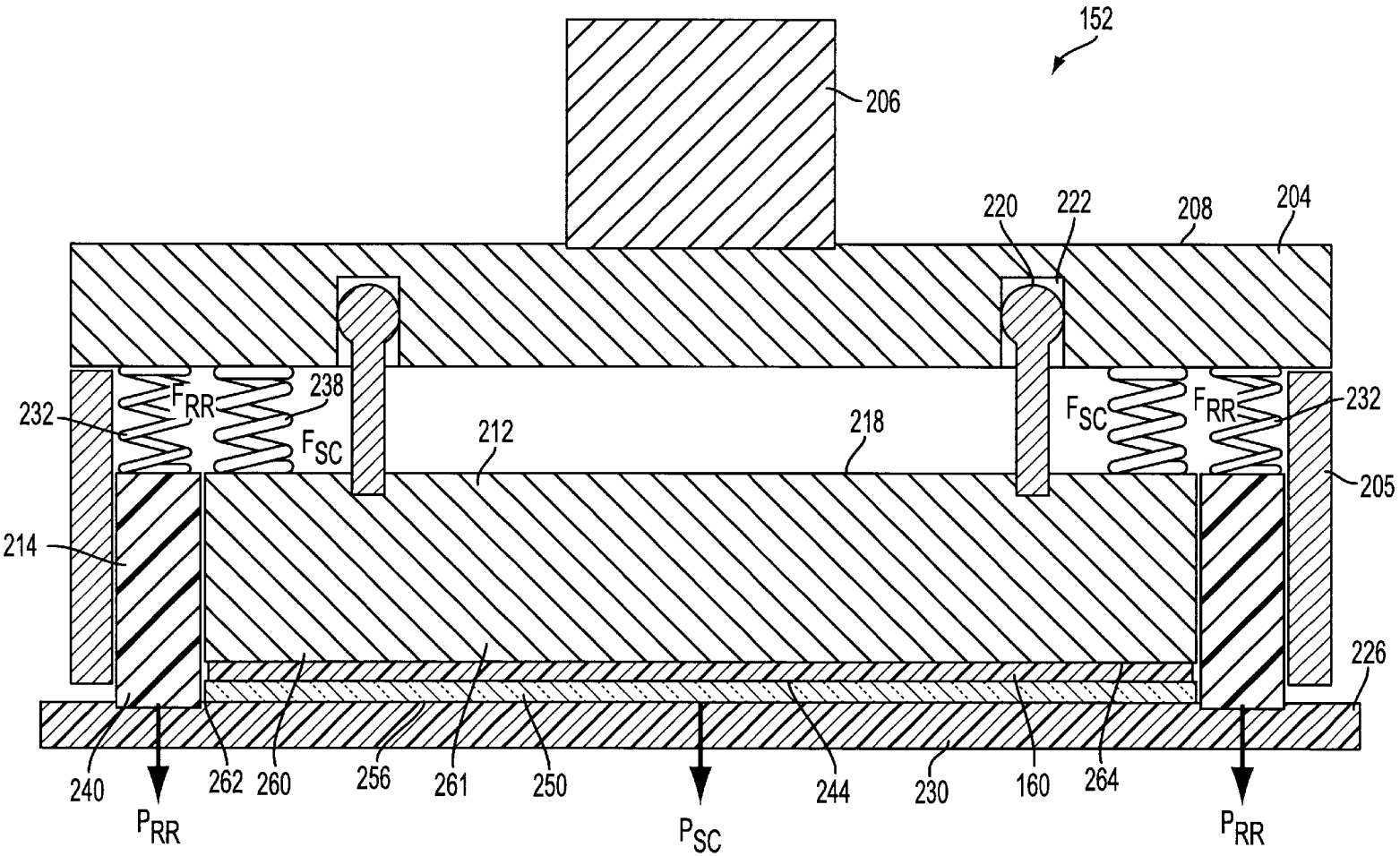
FIG. 2 (PRIOR ART)
FIG. 2 is a diagrammatic illustration showing a conventional CMP head.

In order to establish the differences between the inventive CMP head and the CMP method associated with use of embodiments of the head, attention is first directed to the simplified prototypical head having conventional design of FIG. 2.

In the embodiment of FIG. 2, mechanical coil springs are used to illustrate the application of different forces to different portions of the head. In fact, though springs may in theory be used to practice the invention, pneumatic pressure in the form of air pressure or hydraulic pressure may typically be expected to be used to provide better pressure uniformity over the desired areas. The use of springs in this illustration is primarily to provide clarity of description and to avoid obscuring the invention with unnecessary conventional detail.

The conventional CMP head 152 of FIG. 2 includes a housing top portion 204 and a shaft 206 connecting the housing, and indeed the remainder of the CMP head, to the motor or other source of rotary movement as is known in the art. Typically housing 204 would include an annular shaped housing side portion 205 surrounding the other components in the head to provide a measure of protection from polishing slurry, to protect the internal elements from unnecessary exposure and wear, and to serve as a mechanical guide for other internal elements, such as for example retaining ring 214. In greatly simplified terms, the retaining ring 214 and the subcarrier 212 may be considered as being suspended from a flat horizontal housing plate having an upper surface 208 to which shaft 206 is attached and the lower surface 210 from which retaining ring 214 and subcarrier 212 are suspended.

Subcarrier 212 is connected to the lower surface 210 of housing 204 via shafts 216 fixedly connected to upper surface 218 of the subcarrier and extending toward a spherical tooling ball 220 captured by a cylindrical bore 222 in lower surface 210. Tooling ball 220 may move or slide vertically within the bore 222 to protect relative vertical motion with housing 204. Bore 222 is desirably slightly oversized to permit tooling ball 220 to move without binding and to permit some controlled amount of motion so that when a plurality of tooling ball and bore sets some angular motion or tilt of the subcarrier relative to the housing 204 and polishing pad 226 can occur. However, the fit is sufficiently close so as not to permit any excessive motion or play that would undermine the precision of the head. Tooling balls 220 provide a torque transfer connection between housing 204 and subcarrier 212 so that rotational motion from shaft 206 may be communicated through subcarrier 212 to the wafer 230 being planarized. The retaining ring tooling balls, though not illustrated in the drawings so as to avoid undue complexity that might tend to obscure the invention, may similarly be used to connect to the housing One or more springs 232 are disposed between lower housing surface 210 and an upper surface 234 of retaining ring 214 and acts to separate the retaining ring 214 from the top housing 204. As movement of the housing is constrained during the polishing or planarization operation, the net effect is to press retaining ring 214 downward against the upper surface of polishing pad 226. In this particular embodiment, the type of spring 232 or the number of springs 232 may be adjusted to provide the desired retaining ring force ($F_{RR}$) or retaining pressure ($P_{RR}$). However, if pneumatic pressure is used to urge the retaining ring against the polishing pad 226, pneumatic pressure exerted downward onto retaining ring would be adjusted to achieve the downward force of retaining ring 214 against the polishing pad 226.

In analogous manner, one or more subcarrier springs 238 are disposed between lower housing surface 210 and an upper surface 218 of subcarrier 212 and acts to separate the subcarrier from the housing and to urge the subcarrier toward the polishing pad. Movement of the housing 208 being constrained during the polishing operation, the net effect is to press subcarrier 212 downward toward the upper surface of polishing pad 226. Normally, a separate pneumatic cylinder is used to move and position the head 152 relative to the polishing pad 226. This movement is used for example, to position (lower) the head close to the polishing pad after the wafer or other substrate is loaded for planarization, and to raise the head away from the pad 226 after planarization has been completed. Advantageously as mechanical stop is provided as a reference at the lower limit of movement to assure reasonable repeatability and avoid physical damage to the head or to the wafers.

In this conventional configuration, the lower surface of the subcarrier mounts the semiconductor wafer 230 backside surface 244 either directly, or through an optional polymeric insert 160.

It will be appreciated that the conventional CMP head of FIG. 2 provides a retaining pressure ($P_{RR}$) of the retaining ring 214 against the polishing pad 226, and at least theoretically a single uniform subcarrier pressure ($P_{SC}$) between the front surface of wafer 230 and the surface of the polishing pad. As is understood by workers having ordinary skill in the art, the wafer may not actually experience a uniform pressure over its entire surface due to various factors, including the dynamics associated with the rotating head and rotating pad, local pad compression, polishing slurry distribution, and many other factors. It will also be appreciated by workers having ordinary skill in the art in light of the description provided here that a uniform planarization pressure may not yield a uniform planarization result, and that some controlled planarization pressure variation may be desirable. Such control however, cannot be achieved with the CMP head or planarization method of FIG. 2.

The invention provide several CMP head embodiments and a novel method of polishing and planarization that is appropriate for use with the inventive heads and others. Each of the embodiments provides structure for controllably altering the planarization pressure over at least two regions of the semiconductor wafer as well as separately adjusting the downward force of the retaining ring against the polishing pad. Control of the retaining ring pressure is known to influence wafer planarization edge characteristics as it influences the interaction of the wafer and the polishing pad at the peripheral edge of the wafer. This effect is indirect as the effect of the retaining ring pressure may only be extended for a limited distance under the wafer.

Figure 3A:
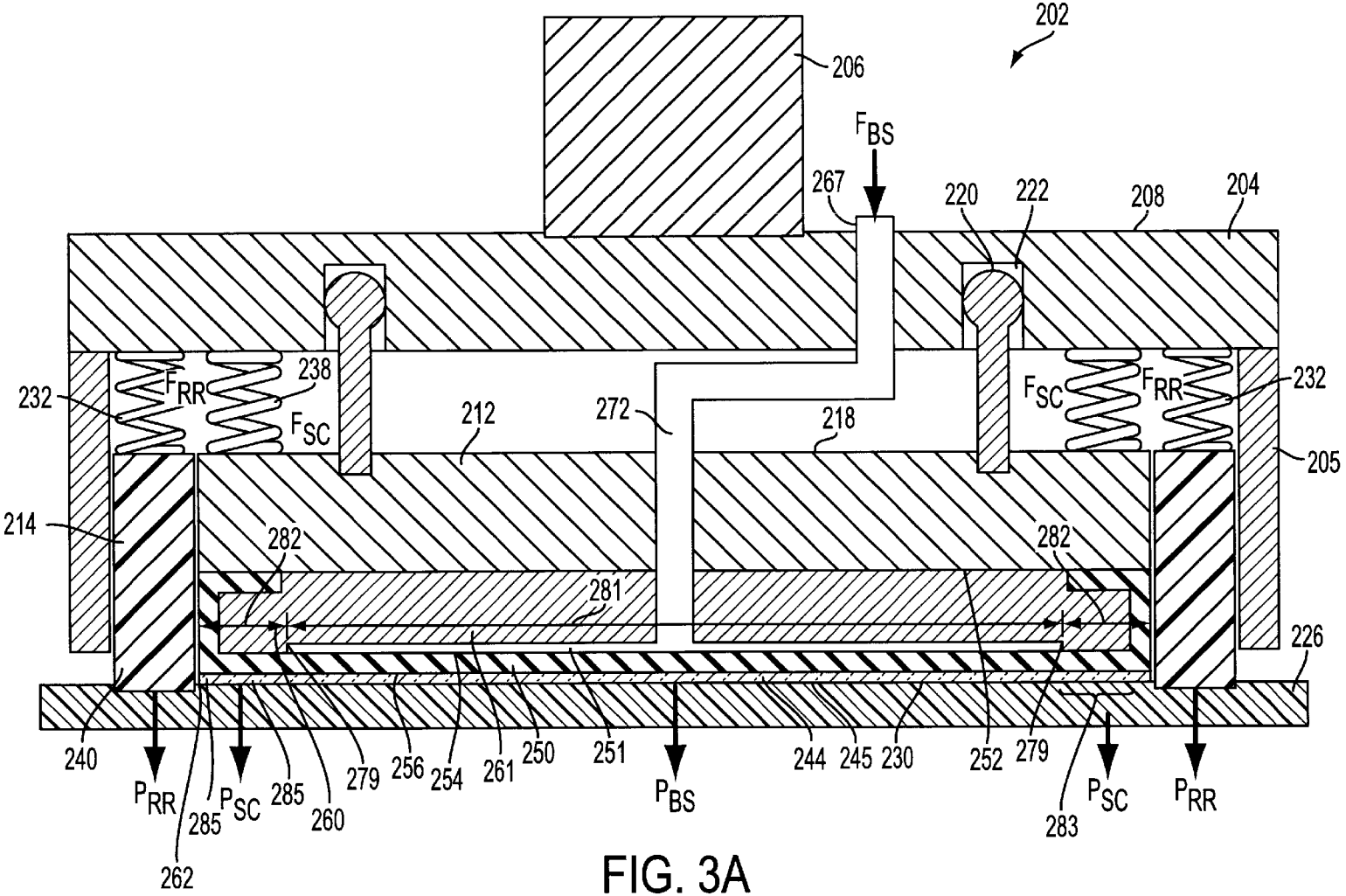
FIG. 3A is an embodiment utilizing a membrane backing plate with pressure chamber recess.
Figure 3B:
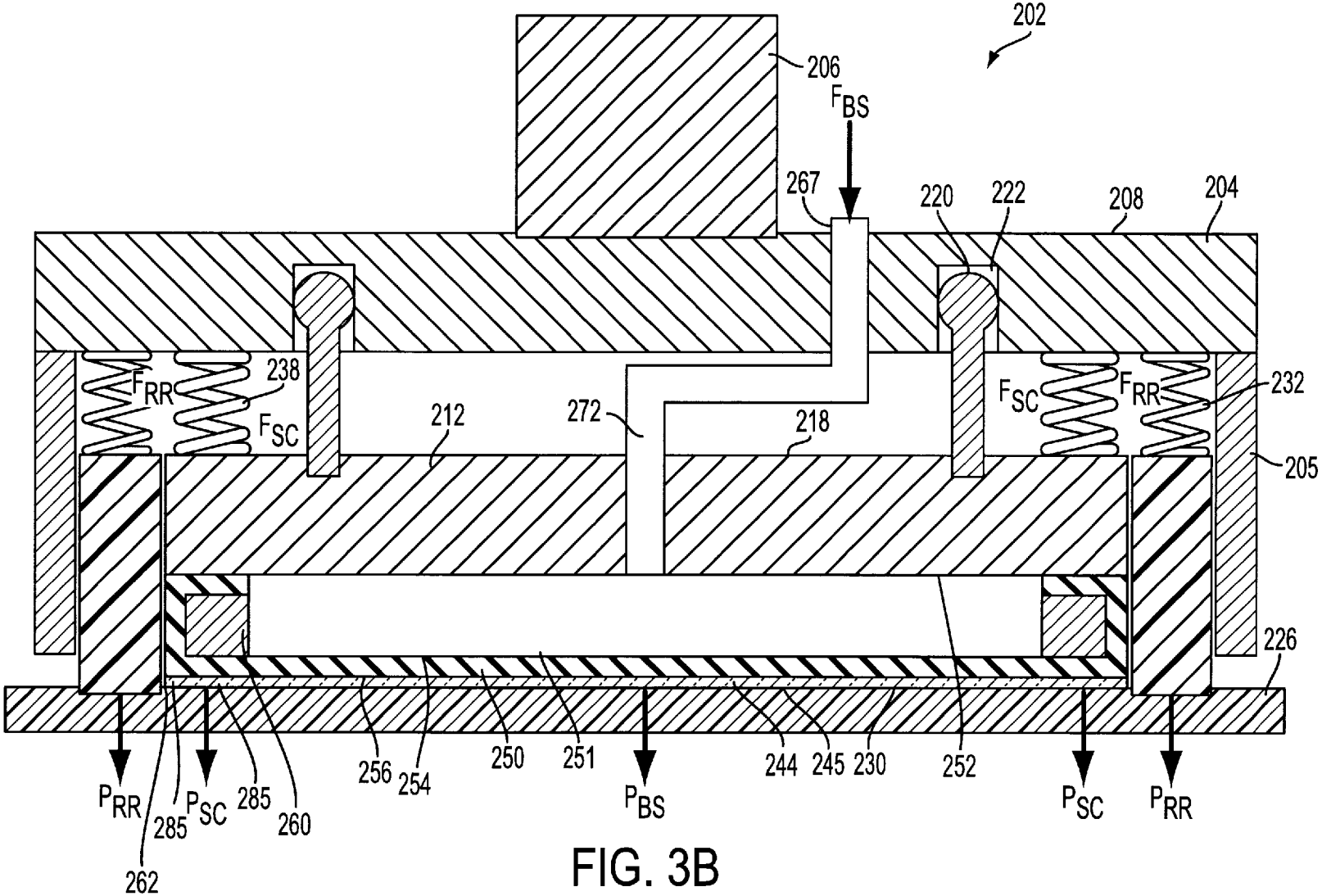
FIG. 3B is an embodiment utilizing an annular corner ring.
Figure 3C:
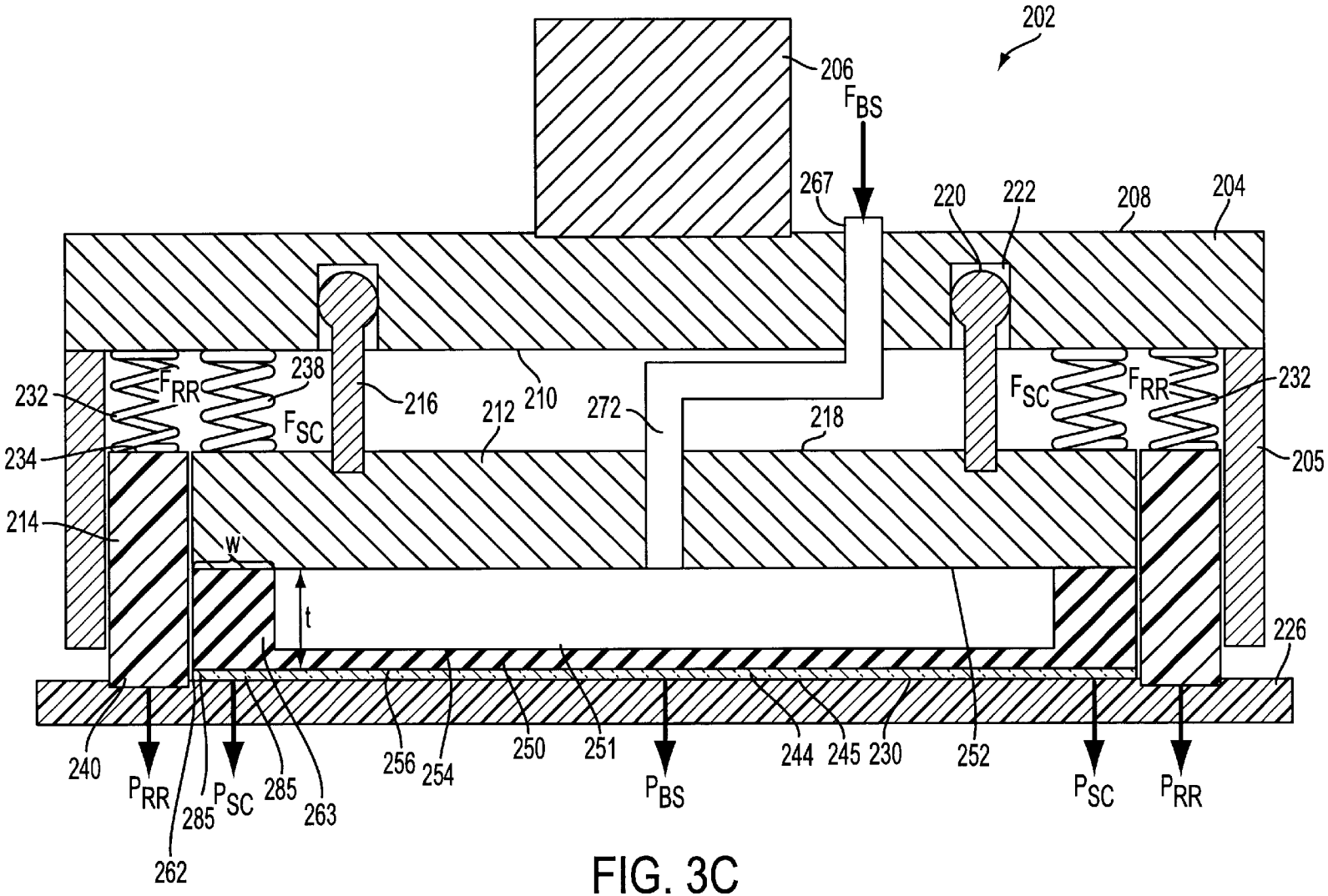
FIG. 3C is an embodiment utilizing a thickened peripheral edge portion of the membrane to transmit a polishing force.

In FIG. 3 are illustrated three related embodiments of the inventive head, each having a membrane and a sealed pressure chamber defined between the subcarrier and the membrane. FIG. 3A illustrates an embodiment with a substantially solid membrane backing plate 26, and FIG. 3B illustrates an embodiment without a membrane backing plate 261 where subcarrier force is communicated from the subcarrier plate 212 to the membrane 250 only at the outer peripheral surface by an annular corner ring 260. The FIG. 3C embodiment is similar to the FIG. 3B embodiment except that the annular corner ring 260 is eliminated and replaced by a thickened portion 263 of the membrane 250 that transmits the subcarrier force. It is noted that in some embodiments, the membrane may be formed of a composite material and or that the corner ring 260 or other structure may be integrally formed within the edge portion of the membrane.

The structure of the embodiment of the inventive CMP head in FIG. 3A is now described in greater detail. Mechanical coil springs 232, 238 are used to illustrate the application of different forces to different portions of the head 202. In fact, though springs may in theory be used to practice the invention, pneumatic pressure in the form of air pressure, or hydraulic pressure may typically be expected to provide better planarization results as such pressure can be uniformly distributed over the desired area and as pressure may monitored would not tend to change over time or require frequent maintenance adjustments that mechanical springs would likely require. The use of springs in this illustration is primarily to provide clarity of description and to avoid the need to conventional structure not relevant to the invention.

The inventive head 202 of FIG. 3 includes a housing top portion 204 and a shaft 206 connecting the housing and indeed the remainder of the head to the motor or other source of rotary movement as are known in the art. Typically housing 204 would include a side housing portion or skirt 205 surrounding the other components in the head, to provide a measure of protection from polishing slurry, to protect the internal elements from unnecessary exposure and wear, and to serve as a mechanical guide for other internal elements. Retaining ring 214 and the subearrier 212 are generally suspended from a horizontal plate forming the housing having an upper surface 208 to which shaft 206 is attached and the lower surface 210 from which retaining ring 214 and subcarrier 212 are suspended.

Subcarrier 212 is connected to the lower surface 210 of housing 204 via shafts 216 fixedly connected to upper surface 218 of the subcarrier 212 and extending toward a spherical tooling ball 220 captured by a cylindrical bore 222 in lower surface 210 of housing top portion 204. Tooling ball 220 may move or slide vertically within the bore 222 to provide relative vertical motion (up and down motion relative to the pad) with housing 204. Bore 222 is desirably has a mechanical tolerance to permit tooling ball 220 to move without binding and to permit some controlled amount of motion so that when a plurality of tooling ball and bore sets (for example 3 sets) some angular motion or tilt of the subcarrier relative to the housing 204 and polishing pad 226 can occur. Tooling balls 220 provide a torque transfer connection between housing 204 and subcarrier 212 so that rotational motion from shaft 206 may be communicated through subcarrier 212 to the wafer 230 being planarized. The retaining ring, though not illustrated in the drawings so as to avoid undue complexity that might tend to obscure the invention, may similarly be connected to the housing using tooling balls in the same manner as described for the subcarrier. Other forms of torque or rotational motion coupling structures and methods are known in the art and may be used.

One or more springs 232 are disposed between lower housing surface 210 and an upper surface 234 of retaining ring 214 and acts to separate the retaining ring from the housing and urge the retaining ring against pad 226. As movement of the housing is constrained during the polishing or planarization operation, the net effect is to press retaining ring 214 downward against the upper surface of polishing pad 226. In this particular embodiment, the type of spring 232 and/or the number of springs may be adjusted to provide the desired retaining ring force ($F_{RR}$) or retaining pressure ($P_{RR}$). However, in the preferred embodiment utilizing pneumatic pressure, pneumatic pressure exerted downward onto the retaining ring (either directly or indirectly) would be adjusted to achieve the downward force of retaining ring 214 against the polishing pad 226.

In analogous manner, one or more subcarrier springs 238 are disposed between lower housing surface 210 and an upper surface 218 of subcarrier 212 and acts to separate the subcarrier from the housing top portion 204. Movement of the housing 208 being constrained during the polishing operation, the net effect is to press subcarrier 212 downward toward the upper surface of polishing pad 226. Unlike retaining ring 214 which has lower surface 240 that presses directly against polishing pad 226, the subcarrier of the present invention does not directly contact the polishing pad, and, in preferred embodiments of the invention does not even directly contact the backside wafer surface 244 of wafer 230. Rather, contact is made through a membrane, diaphragm, or other flexible resilient material at most, and in other embodiments contact is partially or fully through a layer of pressurized air or gas.

In the inventive structure, subcarrier 212 functions primarily to provide a stable platform for the attachment of a flexible film, diaphragm, or membrane 250. In one embodiment (See FIG. 3B and FIG. 3C), a chamber 251 is defined between lower surface 252 of subcarrier 218 and an inner or upper surface 254 of membrane 250. The opposite or outer surface 256 of membrane 250 contacts the backside surface 244 of semiconductor wafer 230. In another embodiment (See FIG. 3A), the chamber 251 is defined between lower surface of membrane backing plate 261 and inner surface 254 of membrane 250. A source of pressurized air or gas at force (FBS) or pressure (PBS) and vacuum is coupled to a fitting 267 at the head surface or via a rotary union and coupled to chamber 251 via a pipe, tube, or other conduit.

Figure 4:
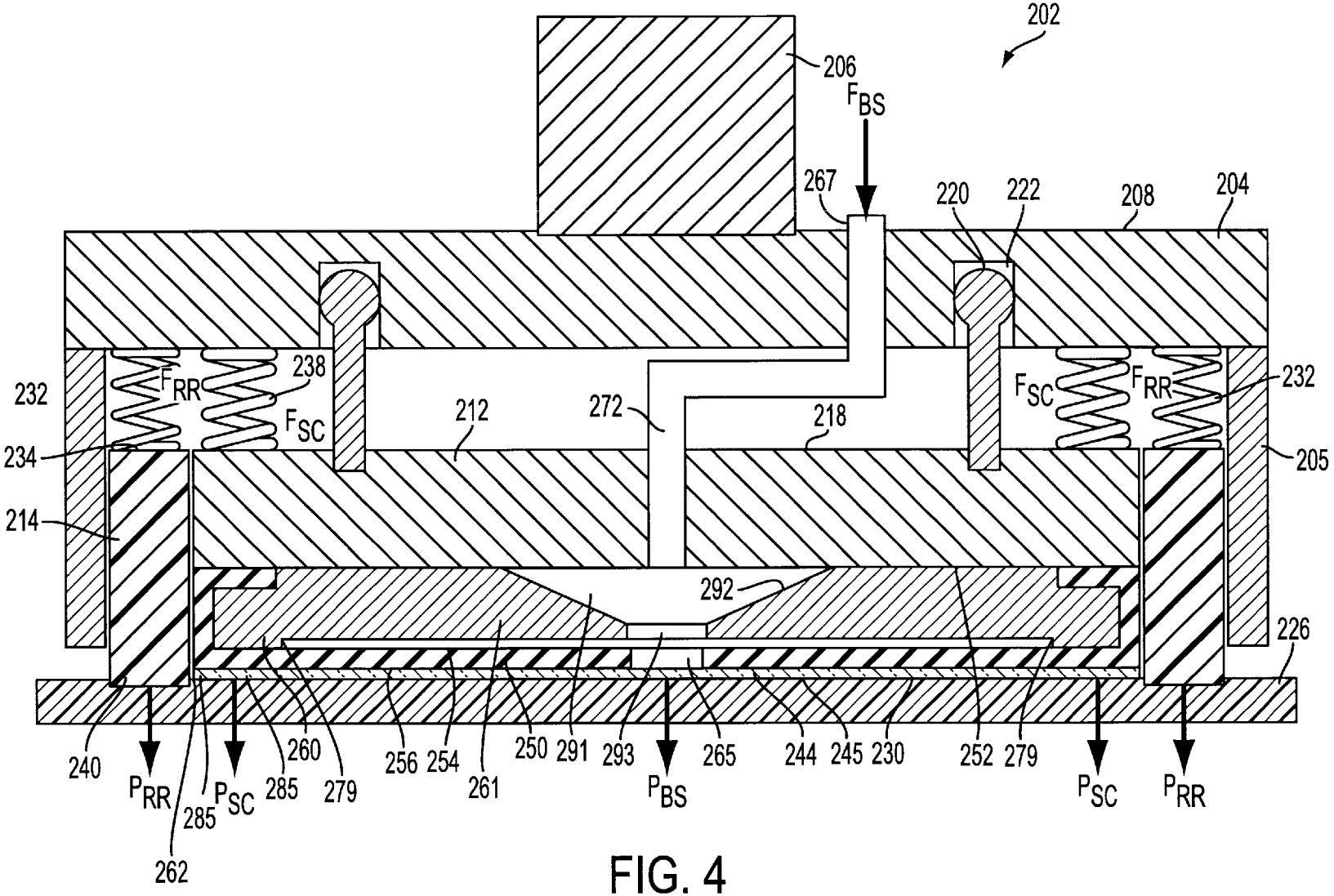
FIG. 4 is a diagrammatic illustration showing is an embodiment of a CMP head having a membrane and orifice.

In the alternative embodiment of FIG. 4, the membrane only partially covers or extends over the backside wafer surface 244 and an orifice 265 or other opening is provided in the membrane 250. In this alternative embodiment, no chamber is formed by the structure of the head itself, rather, backside pressure ($C_{BS}$) builds against the backside wafer surface 244 only when the wafer 230 or other substrate is loaded onto the head (chucked) for polishing.

Figure 6:
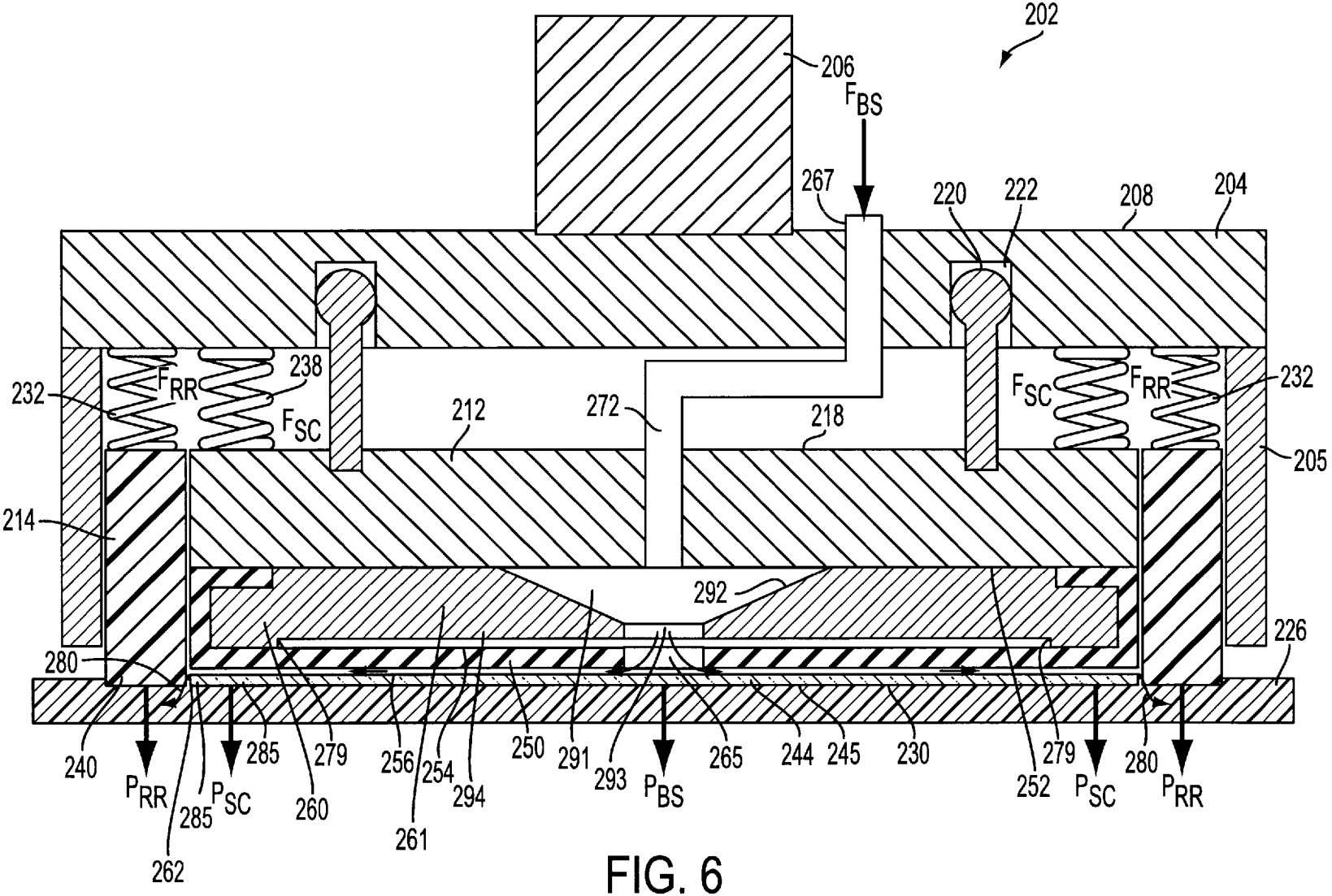
FIG. 6 is a diagrammatic illustration showing an embodiment of a CMP head having a membrane and orifice and cushioning air flow over the surface of the wafer.

In another alternative embodiment of FIG. 6, a volume of air 280 or other gas flows to the backside wafer surface of the wafer is adjusted through the orifice so that air leaks out from between the membrane 250 and the backside wafer surface such that the wafer floats on a cushion of air 280.

Returning to the FIG. 3 embodiment, the inventive structure permits different portions of outer membrane surface 256 to press on wafer backside surface 244 with different pressures in the center portion 281 relative to the edge portion 282 (See FIG. 3A). In the embodiment of the invention illustrated in FIG. 3B, an annular or ring shaped edge or corner piece 260 is the disposed at or near a peripheral edge 262 of the wafer. Although the portion of membrane 250 extends over corner piece 260 so as to provide a substantially continuous membrane to wafer contact area, corner piece 260 is formed from a somewhat firm material so it transmits at least some component of the subcarrier force ($F_{SC}$) to or subcarrier pressure ($P_{SC}$) to wafer backside surface 256. Corner piece 260 may, for example, be formed from a non-compressible or substantially non-compressible material such as metal, hard polymeric material, or the like; or from a compressible or resilient material such as soft plastic, rubber, silicone, or the like materials. Corner piece 260 may alternatively be of the form of a tubular bladder containing air, gas, fluid, gel, or other material, and may either have a fixed volume and pressure or be coupled to a mechanism for altering the volume and/or pressure of the a air, gas, fluid, gel, or other material so that the firmness, compressibility, and the like properties may be adjusted to suit the particular planarization process. The characteristics of the corner piece 260 by and large determine how much of the subcarrier force ($F_{SC}$) is communicated to the backside surface 244 of wafer 230. The purpose of this corner piece 260 is to provide means for adjusting the polishing pressure at the peripheral edge 262 of wafer 230 separately from the polishing pressure exerted on the remainder of the wafer so that material removal and edge effects may be controlled.

It is noted that even when a substantially noncompressible material is used for corner piece 260, portions of the membrane 250 in fact may provide some compressibility and resilience that is beneficial in minimizing any edge transition that might otherwise occur or at the boundary between the corner piece and the interior portions of the wafer. The thickness of membrane 250 may be chosen to provide the desired degree of firmness and resiliency. Different processes may even benefit from different characteristics. It is also noted that although the corner piece 260 illustrated in the embodiment of FIG. 3B is shown as having a rectangular cross-section, the cross-section may alternatively be tapered or rounded so as to provide a smooth transition of surface contour and pressure.

In the embodiment of FIG. 3A, a membrane backing plate 261 provides the functional characteristic of the annular corner piece at the peripheral edge 283 of the wafer 230 and also provides additional support for the wafer when is being held to the head 202 by a vacuum force. The membrane backing plate 261 limits the amount of bowing that the wafer may be subjected to during the holding or chucking operation and prevents cracks from forming within the traces and other structures formed on the wafer front-side surface 245.

Pneumatic pressure (e.g. air pressure) interposed lower membrane backing plate surface 261 (See FIG. 3A) or between lower subcarrier surface 264 (See FIG. 3B and FIG. 3C) and upper membrane surface 254 provides a downward force onto the backside wafer surface 244 through membrane 250. In one embodiment of the invention, the downward backside wafer force ($F_{BS}$) is generated by a pneumatic pressure communicated to cavity 251 through a bore, orifice, tube, conduit, pipe, or other communication channel 272 via fitting 267 and or a rotary union to an external source. This backside pressure is uniformly distributed over the surface of the wafer interior to annular corner piece 260 in the FIG. 3B embodiment, interior to thickened membrane portion 263 in the FIG. 3C embodiment, and is uniformly distributed over the surface of the wafer in cavity 251 formed between a recess 279 in the lower membrane backing plate 261 and the upper membrane surface 254 in the FIG. 3A embodiment having the membrane backing plate.

It will be appreciated that wafer 230 experiences a pressure related to the subcarrier pressure ($P_{SC}$) near its peripheral edge 283 as a result of the effective mechanical coupling between the subcarrier lower surface 252 and an annular shaped portion 285 of membrane 250 stretched over and in contact with the corner ring piece 260 or with the peripheral edge portions of the membrane backing plate. It is noted that the membrane backing plate 261 does not transmit the mechanical force from the subcarrier in its central interior region owing to the concave recess 279 formed in its lower surface. Wafer 230 experiences a pressure related to be backside pressure ($P_{BS}$) in the center of the wafer and extending out toward the edge. In the region adjacent the inner radius of the corner piece 260 or the edge of the concave circular recess in the membrane backing plate 261, some transition between the two pressures ($P_{SC}$ and $P_{BS}$) is typically experienced.

In general, the peripheral wafer edge polishing pressure may be adjusted to be either greater-than, less-than, or equal-to, the central backside wafer polishing pressure. In addition, the retaining ring pressure ($P_{RR}$ may also generally be greater-than, less-than, or equal-to either the central wafer polishing pressure or the edge peripheral polishing pressure. In one particular embodiment of the invention, the retaining ring pressure is generally in the range between about 5 and about 6 psi, more typically about 5.5 psi, the subcarrier pressure is generally in the range between about 3 psi and about 4 psi, more typically about 3.5 psi, and the wafer backside pressure is generally in the range between about 4.5 and 5.5 psi, more typically about 5 psi. However, these ranges are only exemplary as any of the pressures may be adjusted to achieve the desired polishing or planarization effects over the range from about 2 psi and about 8 psi. In some embodiments of the invention, the physical weight of the mechanical element, such as the weight of the retaining ring assembly and the weight of the subcarrier assembly may contribute to the effective pressure.

An alternative embodiment of the structure is illustrated in FIG. 3C. In this alternative embodiment, the corner piece 260 is eliminated and replaced by a thickened portion of membrane 250 which effectively acts as a corner ring or corner piece. The material properties of the membrane and the thickness (t) and width (w) of this thickened portion by and large determine what portion of the subcarrier force is distributed over what portion of the wafer backside surface. Again, while a generally rectangular cross section of the thickened membrane wall is illustrated in the FIG. 3C embodiment, other sectional shapes or profiles of the thickened portion many advantageously be chosen to provide a desired magnitude and distribution of subcarrier force. By suitably selecting the shape, force may be distributed non uniformly, that is as a function of radial distance, from the peripheral edge to achieve a desired material removal characteristic. Where justified by cost or other considerations, even the material properties of the membrane maybe altered as a function of radial distance from the center (particularly in the region of the thickened wall 263) to achieve different force transmission properties through the thickened wall.

In the embodiment of FIG. 3 (as well as in each other embodiment described hereinafter) the region of the wafer 230 over which direct or substantially direct subcarrier force is communicated to the wafer may be adjusted over a fairly wide range. For example, the membrane backing plate material and/or the location of the membrane backing plate recess 279 (FIG. 3A), the corner portion (FIG. 3B) or thickened membrane wall portion may generally extend from between about 1 mm and about 30 mm from the peripheral edge 262, more typically between about 2 mm and about 15 mm, and more usually between about 2 mm and about 10 mm. However in general, the width or extent of the recess, corner portion, or thickened membrane wall portion is determined by the desired results rather than by any absolute limit on physical distance. These dimensions may desirably be determined empirically during testing and establishment of wafer process parameters. In one embodiment of a 200 mm wafer CMP machine, the recess has a diameter of about 198 mm, while in another embodiment the recess is about 180 mm in diameter. In general, the required dimensions will be machine and/or process specific and be determined empirically during development and design of the machine and tuning of the CMP process.

Finally, it is noted that although springs where illustrated as the force generating elements or means for generating the retaining ring force ($F_{RR}$), and subcarrier force ($F_{SC}$), it should be understood that typically springs would not be used for many reasons. For example, providing matching spring characteristics for a large number of springs may be problematic in practical terms, particularly when replacements are required months or years after the original manufacture. Also, the structure of the springs will necessarily physically couple the housing, retaining ring, and subcarrier so that independence of movement may be compromised. Rather, air or fluid tight chambers or pneumatic or hydraulic cylinders are provided so that a pneumatic or hydraulic force or pressure is developed that drives the retaining ring, subcarrier, and membrane. The manner in which pressure chambers are utilized and physical coupling between members is reduced are addressed in the description of the preferred embodiments of the invention in FIG. 10 and FIG. 16 and other figures related to these embodiments.

Several other alternative embodiments that provide separate retaining ring polishing force, wafer edge polishing force, and wafer center polishing force are now described. As the general structure of the embodiments of the invention illustrated in FIG. 4 through FIG. 9 are similar to that of the FIG. 3 embodiment, only the major differences are described here.

In the embodiment of FIG. 4, the membrane 250 includes at least one opening or orifice 265 and no closed chamber is defined by the structure of the head itself. Rather, wafer backside pressure only builds to urge the wafer against the polishing pad after the wafer has been chucked (mounted) to the head and pneumatic pressure has been introduced through orifice 265 behind the wafer. Although an embodiment with a membrane backing plate 261 is illustrated, it is understood that this embodiment may alternatively be practiced with the corner piece 260 or with the thickened membrane edge portion 263 already described relative to FIG. 3B and FIG. 3C. When the membrane baking plate is used, the membrane backing plate optionally but advantageously includes a reservoir 291 that collects any polishing slurry or debris that may be sucked or pulled into the line 272 when vacuum is applied to mount and hold the wafer. This reservoir 291 prevents any such accumulation from clogging the line. Further benefit is realized by providing downward sloping sides 292 for the reservoir, and, optionally a smaller opening to the reservoir 293 than the largest dimension of the reservoir. These features permit a relatively large reservoir capacity, while maintaining maximum wafer backside support, and facilitates drainage of any liquid or slurry out of the line.

Figure 5:
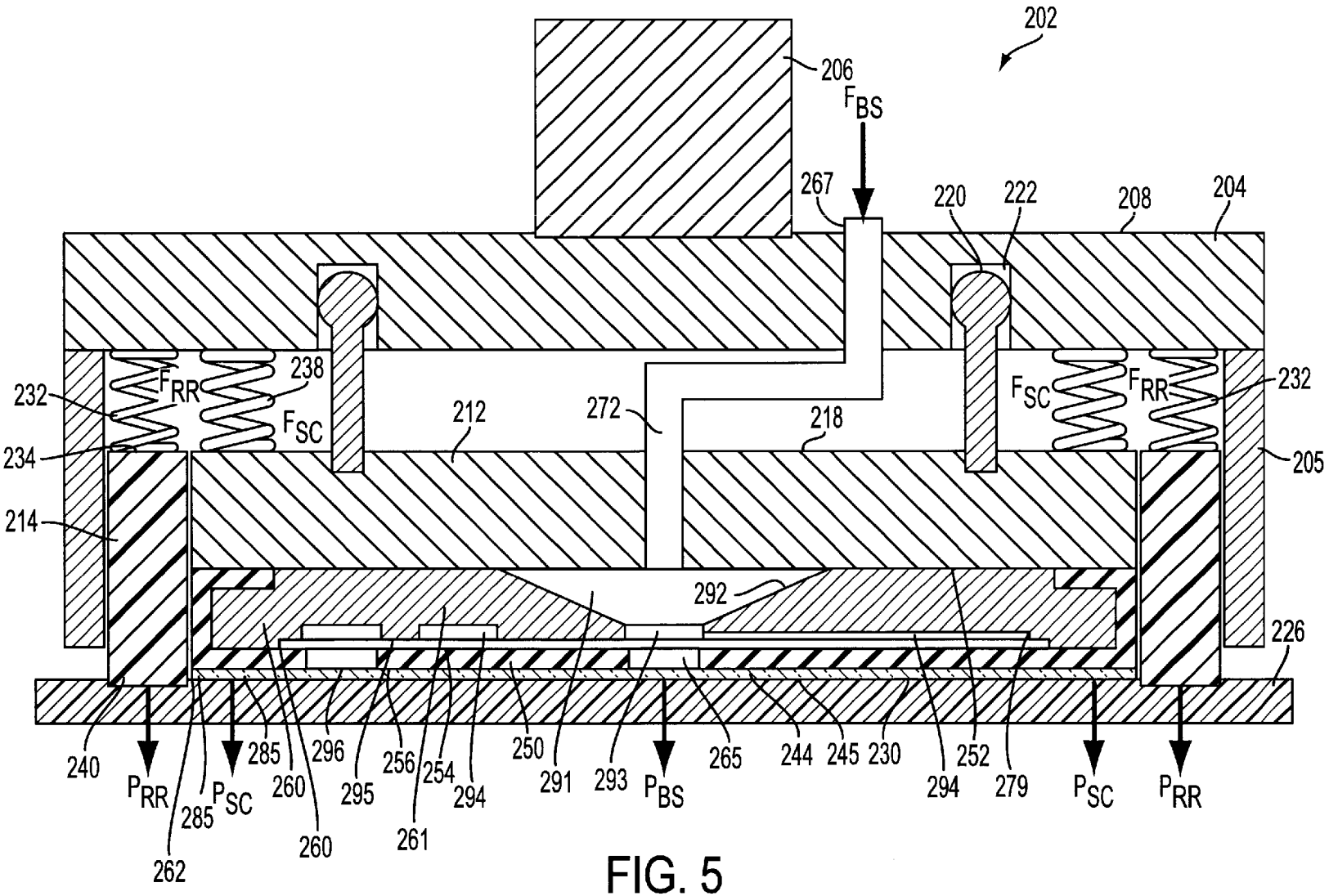
FIG. 5 is a diagrammatic illustration showing an embodiment of a CMP head having a membrane with orifice and a grooved backing plate.

In the embodiment of FIG. 5, the outward facing surface of the membrane backing plate 261 has grooves 294 machined or otherwise formed into the surface to communicate vacuum to different portions of the wafer and to assist testing or sensing for proper wafer positioning. Raised portions 295 are retained to support the wafer and prevent excess bowing. This modification is desirably made since as a result of the orifice, vacuum mounting and holding of the wafer might be compromised. In one embodiment, a combination of radial and circumferential grooves 294 is provided. A wafer presence sensing hole 296 is optionally provided to determine if a wafer is properly mounted to the head. If vacuum pressure can be built behind the wafer, the wafer is properly mounted; however, if vacuum cannot be built there is either no wafer present or the wafer is not properly mounted. Details of such a grooved membrane backing plate are further described relative to the embodiment of FIG. 16, with details of a particular membrane backing plate illustrated in FIG. 17 and FIG. 18.

The embodiment of FIG. 6 also utilizes a membrane 250 having at least one opening or orifice 265, and in addition to controlling the pressure to achieve the desired material removal from the wafer front-side surface, a flow of air or other gas is adjusted to maintain a layer of air (or gas) between the wafer backside surface 244 and the outer membrane surface 256. In this embodiment, the wafer rides on a layer of air. Although only a single orifice 265 is illustrated in the drawing, a plurality or multiplicity of such orifices may be used. The excess air 280 escapes out from between the wafer and the membrane at the wafer edge. Additional conduits may be provided at the retaining ring interface is desired to collect and return the air. Arrows indicated the flow of air over the backside surface of the wafer and out the peripheral edge of the wafer.

Figure 7A:
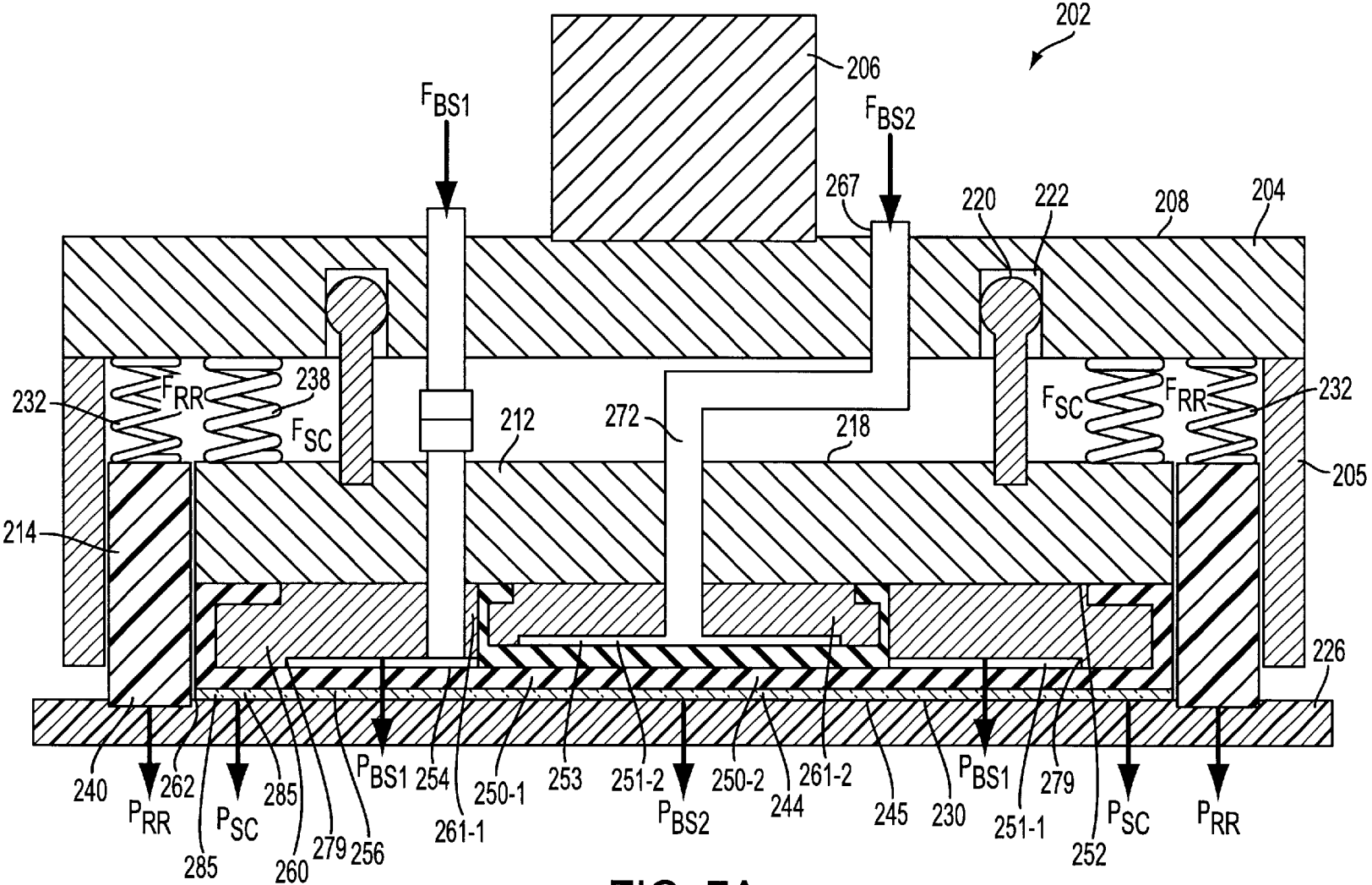
FIG. 7 is a diagrammatic illustration showing embodiments of a CMP head having dual sealed pressure chambers.

The embodiment of FIG. 7 is a variation on the FIG. 3 embodiment and provides a plurality of pressure chambers (in this illustration two pressure chambers exerting forces $F_{BS1}$, $F_{BS2}$ and their corresponding pressures) chambers against the wafer backside surface 244. In the embodiment of FIG. 7A, the embodiment of FIG. 3A is modified by providing a second similar backing plate 261-2 and membrane 250-2 combination interior to the first membrane 250-1. The two structures are overlaid in the central portion so that the pressures even over the central portion of the wafer may be separately controlled, in addition to control of the edge and retaining ring pressures. Although the central chamber 251-2 and membrane 250-2 portion are illustrated as having a backing plate 2612 similar to backing plate 261-1 provided for the larger outer membrane 250-1, a different backing plate structure or no backing plate may alternatively be used. For example, a simple membrane defining a chamber may be used. It is also to be understood that one or both of the membranes may be very thin so that the thickness and separation of the membranes 250-1, 250-2 relative to the backside wafer surface 244 is quite small and maybe somewhat exaggerated in the FIG. 7A illustration to show the structure. In one embodiment, the combined thickness of the two membranes may only be from about 0.5 mm to about 2 mm, though thinner and thicker combinations may be used. In other embodiments, the membranes from the different pressure chambers are abutted rather than overlaid and a separating partition or wall separates the multiple, typically annularly shaped, chambers. In some of these multiple chamber embodiments, the separator walls between adjacent annular pressure chambers or zones will be very thin so that the separator wall is less likely to introduce a pressure discontinuity at a zone boundary. In other embodiments, the wall separating the adjacent annular zones may have a thickened portion.

Figure 7B:
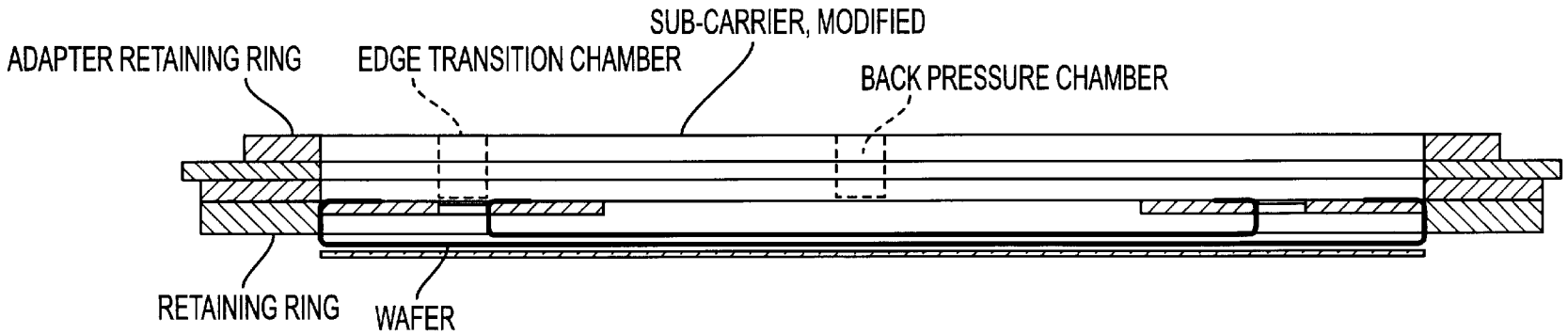

A variation of the structure in FIG. 7A is illustrated in FIG. 7B which shows only portions of the retaining ring and subcarrier without other portions of the CMP head. It is noted that in this embodiment, the outer or edge transition chamber receives a first pressure, and the inner or back side pressure chamber receives a second pressure. The retaining ring receives a third pressure. As already described relative to other embodiments of the invention, either or both of the edge transition chamber or the backside chamber may include an opening or orifice. When the edge transition chamber is to include an opening, such opening is conveniently provided as an annular ring adjacent to the inner back side chamber; with the understanding that in this particular embodiment, the inner and outer membranes do not necessarily overlap, inner membrane having a circular shape and the outer membrane having an annular shape circumscribing the inner membrane.

Figure 8:
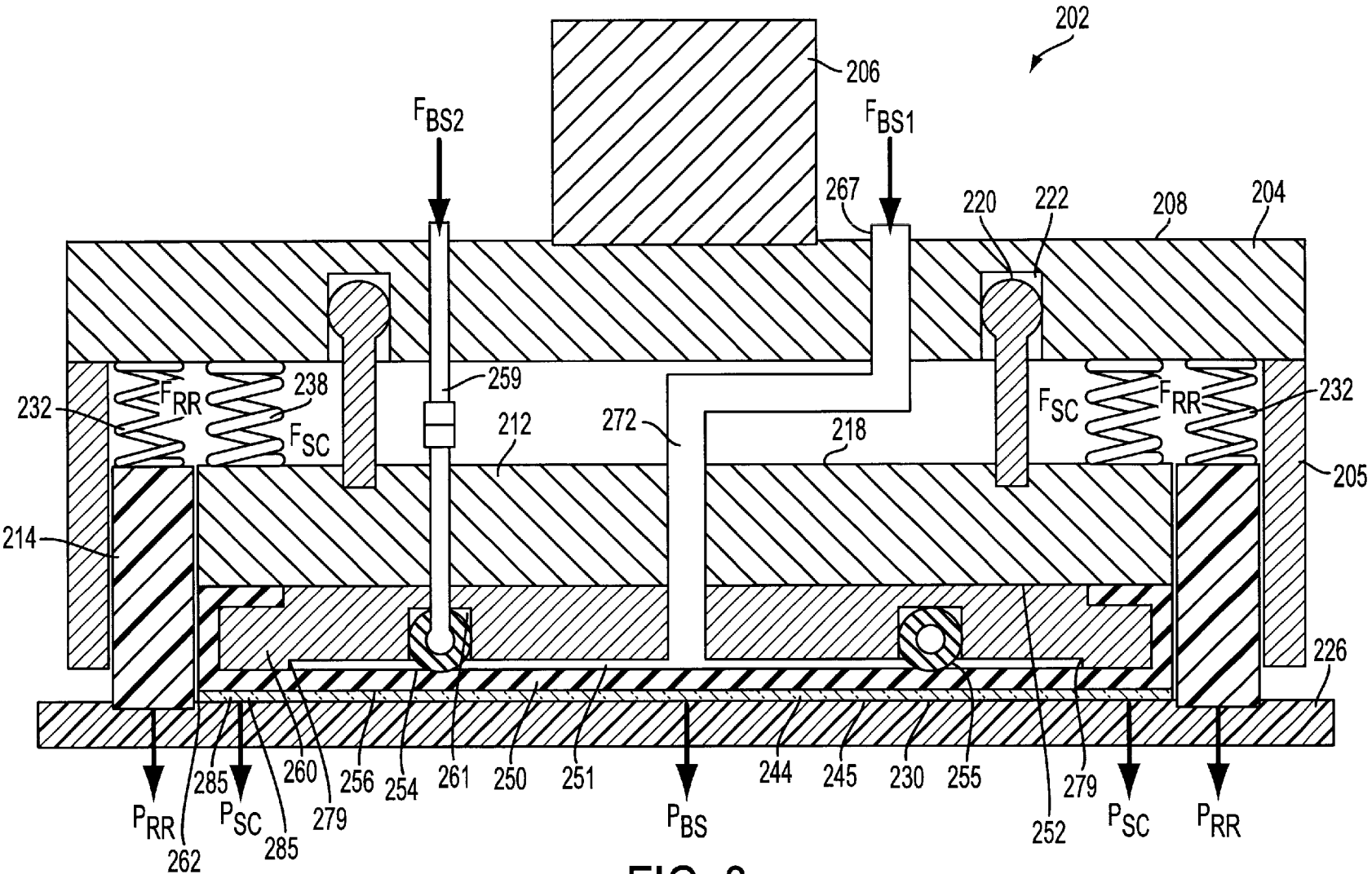
FIG. 8 is a diagrammatic illustration showing an embodiment of a CMP head having a membrane sealed chamber and an annular tubular pressure ring for adding a differential pressure over a portion of the membrane and wafer.

A different variation of the multiple center pressure or differential pressure control concept is provided by the embodiment illustrated in FIG. 8, where an annular shaped substantially tubular pressure ring or bladder 255 is disposed between portions of the membrane backing plate 261 or subcarrier 212, typically within a groove 257 within the subcarrier, and the pressurized tube or bladder 257 is used to provide additional pressure to certain areas where it is desirable to remove additional material. A channel 259 couples pressurized air ($F_{BS2}$) or other fluid from an external source to the tubular bladder 257. When pressurized, the tube presses against the inner membrane surface 254 to locally increase the planarization pressure ($P_{BS1}$) otherwise present by virtue of chamber 251.

Figure 9:
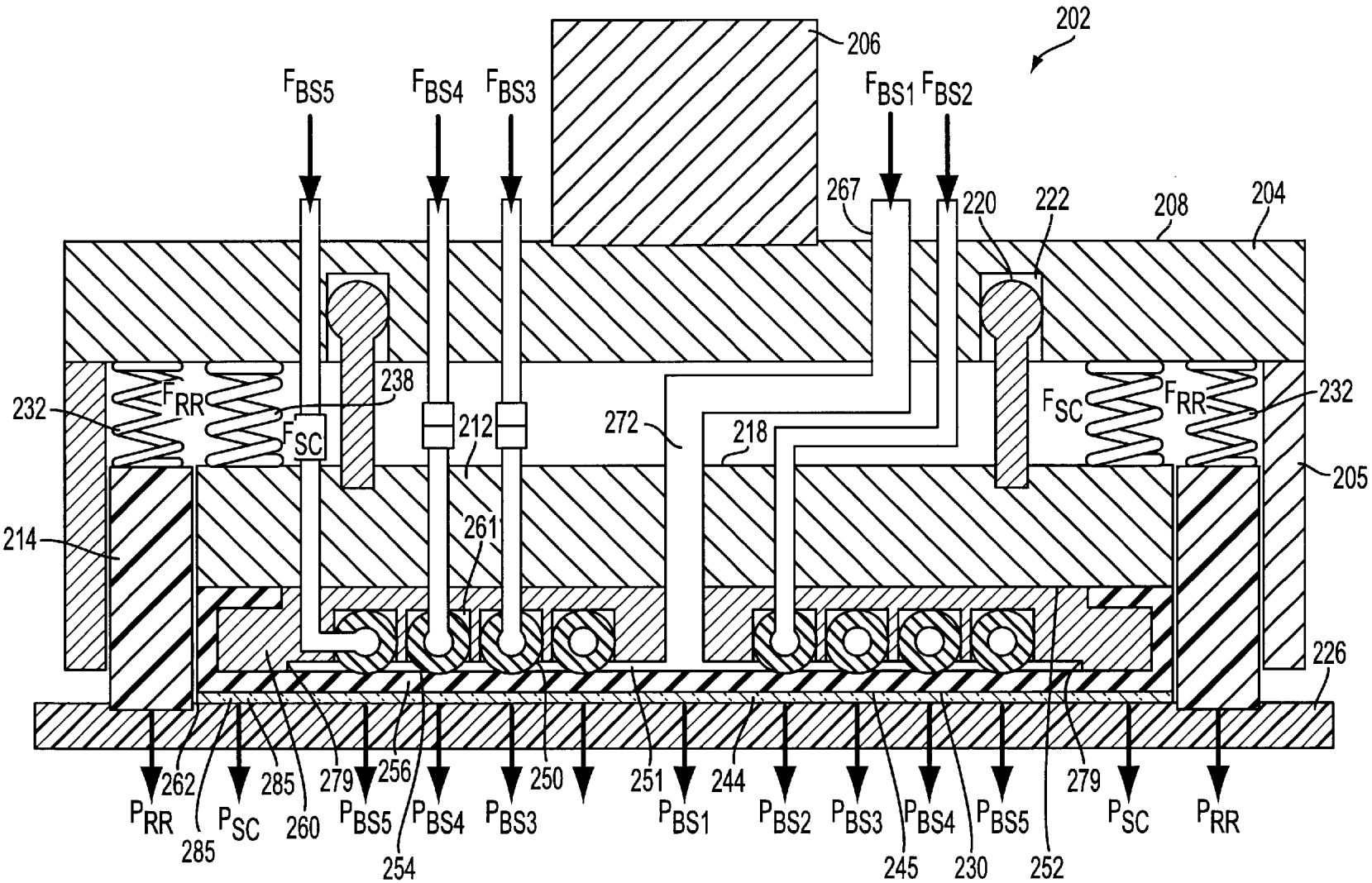
FIG. 9 is a diagrammatic illustration showing an embodiment of a CMP head having a membrane sealed chamber and a plurality of annular tubular pressure ring for adding a differential pressure over a plurality of regions of the membrane and wafer.

The FIG. 9 embodiment extends this concept even further to provide for a plurality of abutting or substantially abutting concentric tubular pressure rings or bladders 255 such that a region may be polished or planarized at a higher or at a lower pressure than the surrounding regions. While tubular rings or bladders having a substantially circular cross section are illustrated, it is understood that in both the FIG. 8 and FIG. 9 embodiments, the shape of the tube may be conveniently chosen to have the desired pressure or force profile against the membrane and hence against the wafer 230. Pressurized gas or fluid ($F_{BS1}$, $F_{BS2}$, $F_{BS3}$, $F_{BS4}$, $F_{BS5}$) are adjusted to provide the desired polishing pressure profile across the wafer surface. In one embodiment, the tube has a generally circular cross section, while in a preferred embodiment, the tube has a rectangular cross section and a substantially flat surface of the tube is pressed against the membrane. In the embodiment of FIG. 9, the annular tubes may have different radial extents or widths between inner and outer diameters.

While each of these several embodiments have been described separately, it will be clear to those workers having ordinary skill in the art in light of the description provided here that elements and features in one embodiment may be combined with elements and features in other embodiments without departing from the scope of the invention.

These embodiments illustrated some of the important features of the CMP head un-obscured by particular implementation details. Once the structure in operation of these embodiments are understood, the structure, planarization methodology, and advantages of the embodiment in FIG. 10 and FIG. 16 will be more readily understood and appreciated.

Recall in the conventional design of FIG. 2, a similar head design utilizing a conventional polymeric insert 160 interposed between lower subcarrier surface 264 and wafer backside surface 244. In this structure, the pressure exerted against the backside surface 244 of wafer 230 is uniform (or at least intended to be uniform). No structure or mechanism is provided for altering the pressure at or near the peripheral edge of the wafer relative to either the pressure exerted against the central portion of the wafer or the pressure exerted by retaining ring 214 against the upper surface of polishing pad 226.

Having described several alternative embodiments of the inventive structure relative to FIG. 3 through FIG. 9, and compared those structures and the planarization methods they provide to conventional structures, such as the structure in FIG. 2, attention is now directed to a more detailed description of the two preferred embodiment of the invention, one utilizing a thin membrane and sealed pressure chamber (FIG. 10) and the second embodiment (FIG. 16) having a membrane with an open orifice, which though similar to the embodiments described relative to FIG. 3 and FIG. 5 respectively, provide additional features and advantages over those embodiments. Those workers having ordinary skill in the art in light of the description provided here will appreciate that the alternatives described relative to FIG. 5 through FIG. 9 of these embodiments may also be made relative to the FIG. 10 and FIG. 16 embodiments.

By providing the relatively stiff ring of rubber at the outside edge of the wafer and applying the sub-carrier pressure, the amount of material removal at the edge can be controlled relative to the amount of material removed in regions interior to the edge, such as relative to the center of the substrate.

The sub-carrier pressure presses the rubber ring against the wafer backside forming a pressure tight seal. Pressing down to the wafer through the rubber ring at the edge also permits control of the wafer edge removal rate relative to the wafer interior or central removal rate so that edge non-uniformity can be controlled and limited.

It is noted that in some head designs that provide wafer backside pressure using a diaphragm, no known conventional CMP head provides structure that permits application of differential pressure at the edge versus at interior regions. In the inventive structure, a higher subcarrier pressure relative to the backside pressure increases the amount of material removed relative the to center of the wafer and a lower subcarrier pressure relative to the backside wafer pressure decreases the amount of material removed from the edge relative to the center. These two pressure may be adjusted either to achieve uniform or substantial uniform material removal, or where earlier fabrication processes have introduced some non-uniformity, to achieve a material removal profile from edge to center that compensates for the earlier introduced non-uniformities.

In these embodiments of the invention, the subcarrier is retained primarily to provide a stable element that will communicate the subcarrier pressure chamber uniformly to the rubber ring and hence to the region near the edge of the wafer. (Recall that embodiments of the invention are provide to adjust the pressure at the edge so that absolute uniform pressure may not be desired or provided.) Except for modest flatness requirements at the peripheral edge where downward pressure is applied to the wafer through the rubber ring, the flatness and smoothness of the subcarrier surface are immaterial. The subcarrier may therefore be a lower-precision and less costly part.

These structures provide a polishing (or planarization) apparatus, machine, or tool (CMP tool) for polishing a surface of a substrate or other work piece, such as a semiconductor wafer. The apparatus includes a rotatable polishing pad, and a wafer subcarrier which itself includes a wafer or substrate receiving portion to receive the substrate and to position the substrate against the polishing pad; and a wafer pressing member including a having a first pressing member and a second pressing member, the first pressing member applying a first loading pressure at an edge portion of the wafer against the polishing pad, and the second pressing member applying a second loading pressure a central portion of the wafer against the pad, wherein the first and second loading pressures are different. Although this wafer subcarrier and wafer pressing member may be used separately, in a preferred embodiment of the invention, the polishing apparatus further includes a retaining ring circumscribing the wafer subcarrier; and a retaining ring pressing member applying a third loading pressure at the retaining ring against the polishing pad. The first, second, and third loading pressures are independently adjustable.

Figure 10:
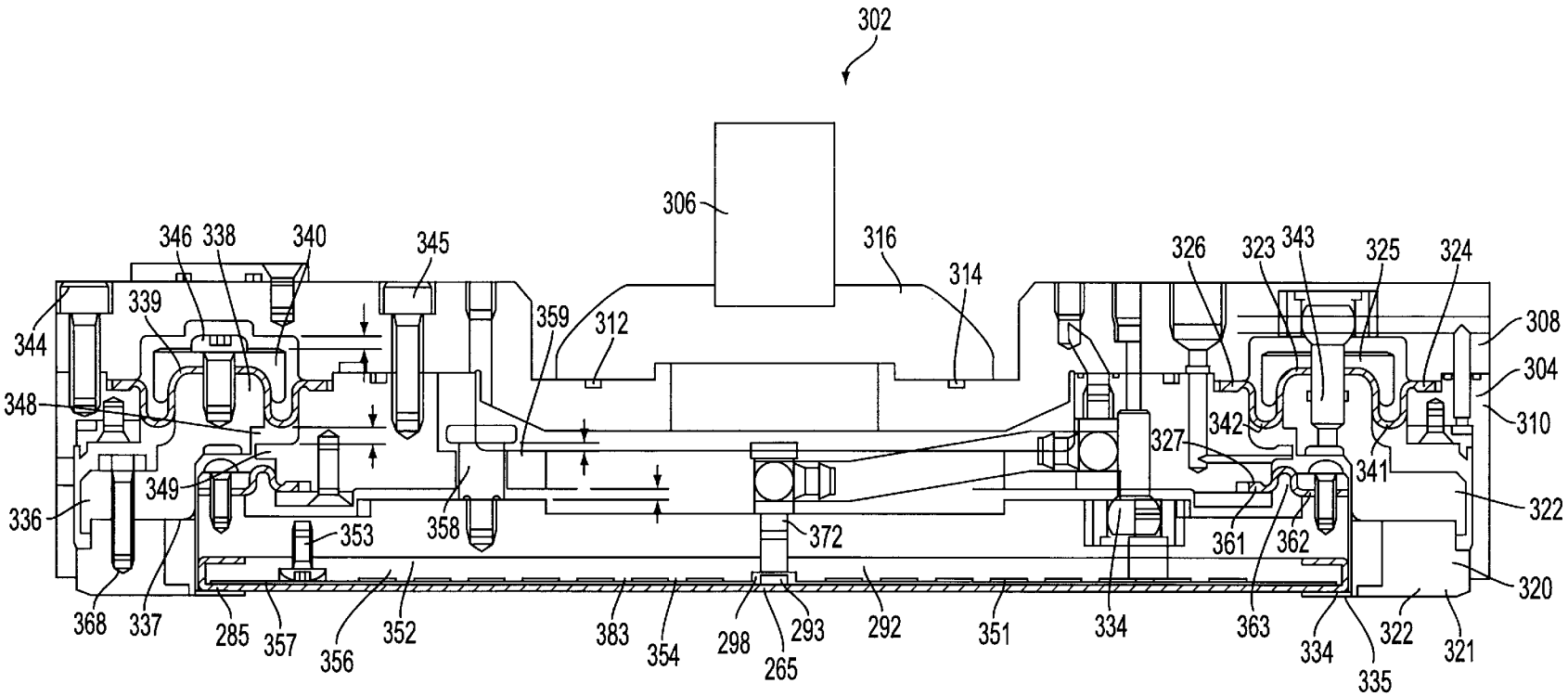
FIG. 10 is a diagrammatic illustration showing a preferred embodiment of the inventive head having a membrane a sealed pressure chamber.

The inventive head 302 of FIG. 10 includes a housing 304 including an upper housing plate 308, a lower housing skirt 310, and an internal housing plate 312. Upper housing plate 308 attaches via screws or other fasteners 312, 314 to shaft 306 via a shaft attachment collar 316. While a simple shaft 306 is illustrated, it is understood that shaft 306 is generally of conventional design and includes, for example, bearings (not shown) for rotatably mounting the shaft to the remainder of the polishing machine, one or more rotary unions 305 for communication gases and/or fluids from stationary sources of such gasses or fluids off the head to the head. An example of the type of shaft and rotary union that may be used with the inventive head structure is illustrated for example in U.S. Pat. No. 5,443,416 entitled *Rotary Union for Coupling Fluids in a Wafer Polishing Apparatus* by Volodarsky et al, assigned to Mitsubishi Materials Corporation, and hereby incorporated by reference.

In the afore described embodiments, upper housing plate 308 provides a stable mechanical platform from which to suspend or mount the retaining ring assembly 320 and the subcarrier assembly 350. Lower housing skirt 310 provides protection over the outer peripheral portions of retaining ring assembly 320 such as preventing the entry of polishing slurry into the interior of the head, controls or restricts the horizontal movement of the retaining ring assembly 320, and is operative to clamp an outer radial edge portion 324 of the flexible retaining ring assembly mounting ring 323 to the upper housing plate 308.

Internal housing plate 312 attaches to the lower surface of upper housing plate 308, and is operative to clamp an inner radial edge portion 326 of the flexible retaining ring assembly mounting ring 323 to the upper housing plate 308. Internal housing plate 312 is also operative to clamp an inner radial edge portion 328 of flexible subcarrier assembly mounting ring 327 to the inner housing plate 312 and by virtue of its direct connection to upper housing plate 308, to upper housing plate 308 as well.

While the FIG. 3 and FIG. 4 embodiments were described relative to simple one piece generally cylindrical and annular shaped subcarrier and retaining ring, the present embodiment provides somewhat more complex assemblies comprising a plurality of components to perform these functions. Hence reference to retaining ring assembly rather than to the retaining ring, and reference to subcarrier assembly rather they and to subcarrier. The structural and operational principles already described pertain to these additional embodiments, and, it is understood that the inventive features described relative to the embodiments illustrated in FIG. 3 through FIG. 9 may be enhanced and elaborated with the particular implementation details described relative to the embodiments in FIG. 10 and FIG. 16.

Retaining ring assembly 320 comprises a retaining ring 321 which contacts polishing pad 226 on a lower ring wear surface 322 in constraints movement of wafer 230 in the horizontal plane of the pad 226 by defining a wafer pocket 334 along the interior radial edge 335. Retaining ring assembly 320 also comprises the generally annular shaped suspension plate 336 having a lower surface 337 and an upper surface 338. The lower surface 337 attaches to an upper surface of retaining ring 338 (the surface opposite to wear surface 321) and the suspension plate extends upward from the lower surface to upper surface 338 where that surface cooperates with the lower surface 339 of a clamp 340 to moveably attach the retaining ring suspension plate 322 to the housing 308 via a generally annular shaped retaining ring suspension coupling element 325.

In one embodiment of the invention, the retaining ring pressure is compensated for retaining ring wear. When a non-rectangular retaining ring wears away, surface area touching the pad changes with time and wear. As a result, the pressure established for the process (for example 5 psi) does not have the intended effect and should desirably be modified to accommodate the larger surface. A non-rectangular retaining ring shape, such as a retaining ring shape the provides a beveled outer edge, is preferable as it improves distribution of polishing slurry to the wafer and pad beneath the wafer. You have this angle, you can have the slurry getting easy. Therefore, retaining ring pressure may be independently controlled relative to both subcarrier pressure at the edge of the wafer and backside pressure in the more central regions of the wafer. Desirably, the retaining ring wear pressure compensation is automated and under computer control, based for example, either on the number of wafers processed, hours of operation, manual measurements, or sensors that detect the actual amount of retaining ring wear.

In one embodiment, the retaining ring suspension element 325 is molded from a flexible rubber-like material (EPDM material) to include two annular channels 341, 342 on either side of clamp 340. These two channels appear as curved loops in cross section (See detail in FIG. 12) and provide relatively frictionless vertical movement of the retaining ring assembly relative to the housing 304 and subcarrier assembly 350. Furthermore, this type of suspension element 325 decouples the movement of the retaining ring assembly 320 and of the subcarrier assembly 350 so that the movements are independent or substantially independent, except for possible friction generated at their sliding surfaces.

The suspension of the retaining ring assembly 320 relative to the housing 304 is achieved at least in part by clamping an outer radial edge portion 324 between the portion of the upper housing 308 in the lower housing skirt 310, such as with screws 344 or other fasteners. In similar manner, an inner radial edge portion 326 is clamped between another portion of the upper housing 308 and the lower housing skirt 310 such as with screws 345 or other fasteners. The mid portion 343 of the suspension element 325 is clamped to between the upper surface of retaining ring suspension plate 336 and clamp 339 using a screws 346 or other fasteners. Desirably, edges and corners of the housing 304, retaining ring suspension plate 336, and clamp 339 are rounded to approximate the nominal curvature of retaining ring suspension element 325 at that point of contact to reduce stress on the suspension element and to prevent wear and prolong life of the element. The channels or loops 341, 342 are sized to provide a range of motion vertically (up and down relative to the polishing pad) for the retaining assembly 320.

The movement of the retaining ring assembly 320 is advantageously constrained to a predetermined range of motion that is sufficient for wafer loading, wafer unloading, and polishing operations. While there are a variety of interfering mechanical structures that might be utilized to limit the range of motion, in the embodiment illustrated in FIG. 10, a notch 348 in retaining ring suspension plate 336 is provided to make contact with a mating protrusion 349 extending from the internal housing plate 312 so that movement of the retaining ring assembly beyond predetermined limits is prevented. Such over range protection is desirably provided to protect internal components, particularly the retaining ring suspension element 325, from damage or premature wear. For example, if the entire weight of the retaining ring assembly were to be supported by the retaining ring suspension element 325, the retaining ring suspension element 325 would likely be damaged or at least be subject to premature wear.

Figure 11:
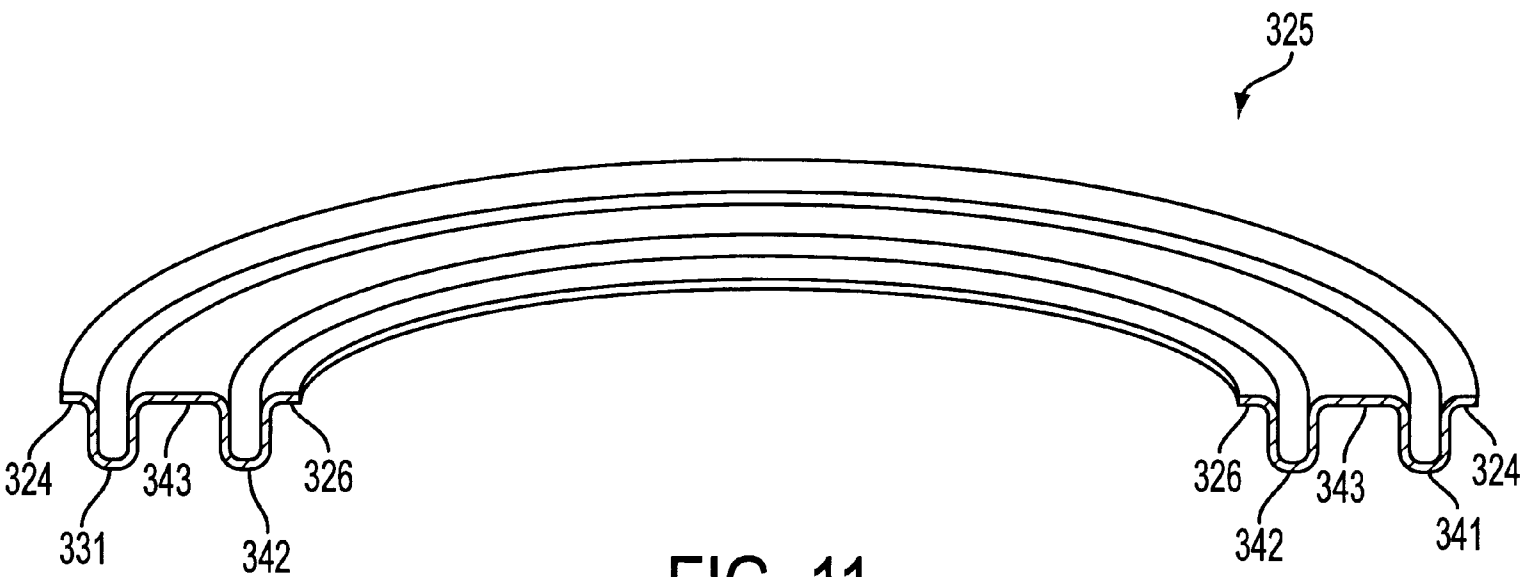
FIG. 11 is a diagrammatic illustration showing an embodiment of the retaining ring suspension member used in the embodiment of FIG. 10.

An embodiment of the retaining ring suspension element 325 is illustrated in FIG. 11 which illustrates a perspective and partial half-sectional view of the element showing mid portion 343, inner and outer loop or channel portions 342, 343, and inner and outer radial edge portions 324, 326.

The subcarrier assembly 350 includes a subcarrier support plate 351, a membrane backing plate 352 attached to the support plate 351 by screws 353 or other fasteners, membrane 250, and in one embodiment a backside pressure chamber 354 defined generally between a lower or outer surface 355 of membrane backing plate 352 and an inner surface 356 of membrane 350. Other embodiments of the backside pressure chamber 354 are provided by the invention and are described in greater detail below.

Subcarrier assembly 350 also desirably includes a mechanical stop 358 in the form of a stop screw or stop bolt 358 that is attached to support plate 351 and interferingly interacts with a stop surface 359 of internal housing plate 312 through a hole 359 in internal housing plate 312 to prevent over extension of the subcarrier assembly from the housing if the head is lifted away from the polishing pad 226. The stop bolt 358 is chosen to provide an appropriate range of motion of the subcarrier within the head during loading, unloading, and polishing, but not such a large range of motion that internal elements of the head would be damaged by over extension. For example, as with the retaining ring assembly, if the entire weight of the subcarrier assembly 350 were to be supported by the subcarrier assembly suspension element 360, the subcarrier suspension element 360 would likely be damaged or at least be subject to premature wear.

As described relative the embodiments in FIG. 3 and FIG. 4, tooling balls or equivalent mechanical structures such as keys, splines, shims, diaphragms, or the like may be used to couple the housing 208 to the subcarrier assembly 350 and to the retaining ring assembly 320 for rotational motion.

In one alternative embodiment, a thin sheet 329 of material such as metal (for example, thin stainless steel) is used to communicate torque to the retaining ring assembly and subcarrier assembly as illustrated in FIG. 12. This structure permits relative vertical motion between the housing and the attached retaining ring assembly or subcarrier assembly while also transferring rotational movement and torque between the coupled members. The design of such as metal coupling 339 is such that torque is transferred in only one rotational direction but as the head is rotated in only one direction, this limitation is not problematic. Other diaphragm type couplings may alternatively be used to couple the housing to the retaining ring assembly and/or to the subcarrier assembly. The inventive features described herein are not limited to any particular retaining ring or subcarrier suspension system.

The mechanical structures of the housing, retaining ring assembly, and subcarrier assembly are designed to reduce the footprint of the CMP head. For example, a portion of the retaining ring suspension plate overlays a portion of the subcarrier support plate. These and other aspects of the mechanical structure desirably reduce the size of the head and make possible a smaller CMP machine generally.

An outer radial portion 361 of subcarrier assembly suspension element 360 is attached to an upper surface 366 of subcarrier support plate 351 by a first clamp 367. The clamp 367 may for example include an annular shaped ring 368 overlying the outer radial portion 361 and secured by screws 369 through holes 364 in the suspension element 360 to the subcarrier support plate 351. An inner radial portion 362 of subcarrier assembly suspension element 360 is attached to a lower surface 370 by a second clamp 371. The second clamp 371 may for example include an annular shaped ring 371 overlying the inner radial portion 362 and secured by screws 372 through holes 364 in the suspension element 360 to the subcarrier support plate 351.

Figure 13:
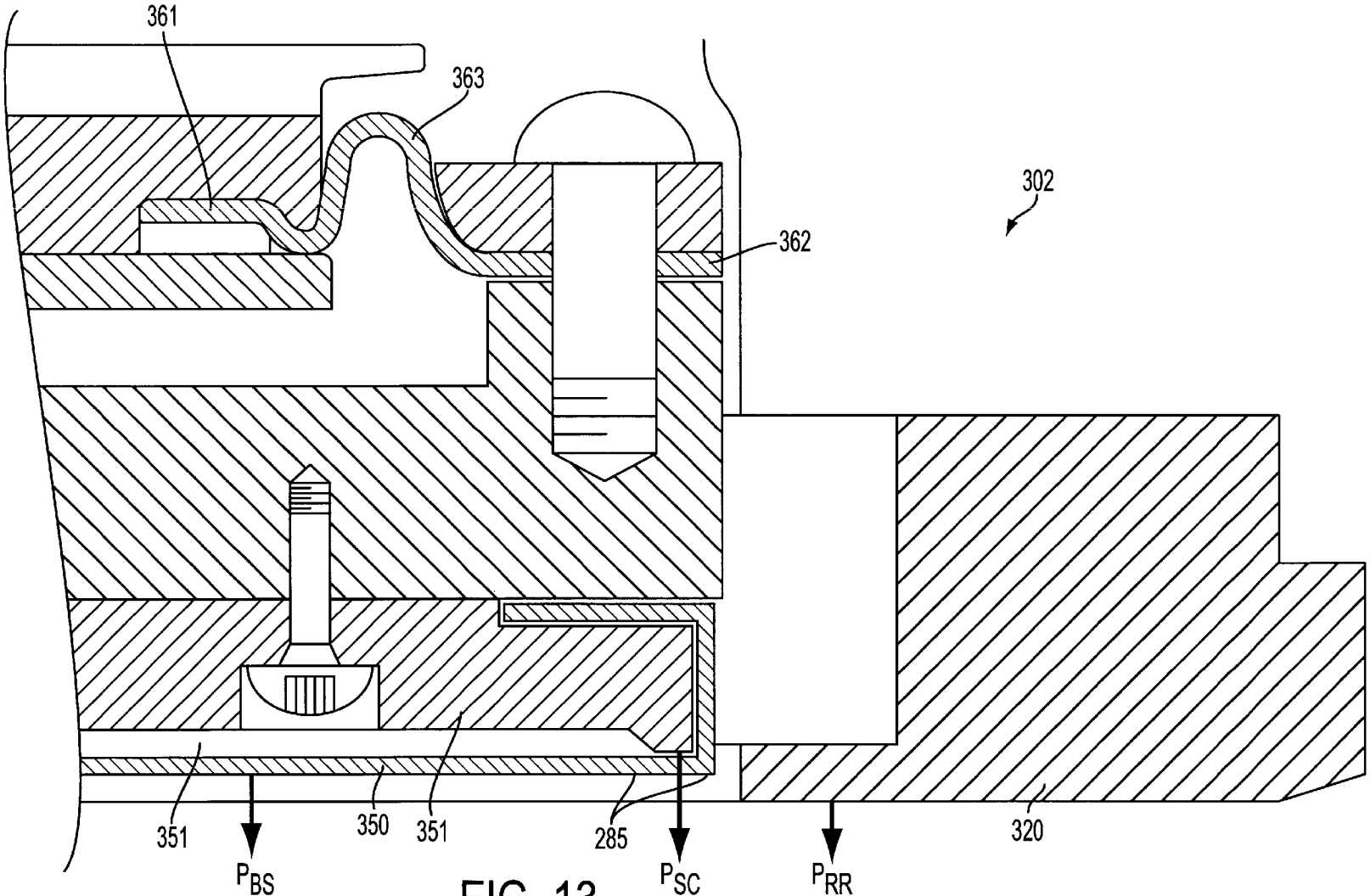
FIG. 13 is a diagrammatic illustration showing a detail of the CMP head of FIG. 10 illustrating the attachment of subcarrier assembly suspension member in the assembled head.
Figure 14:
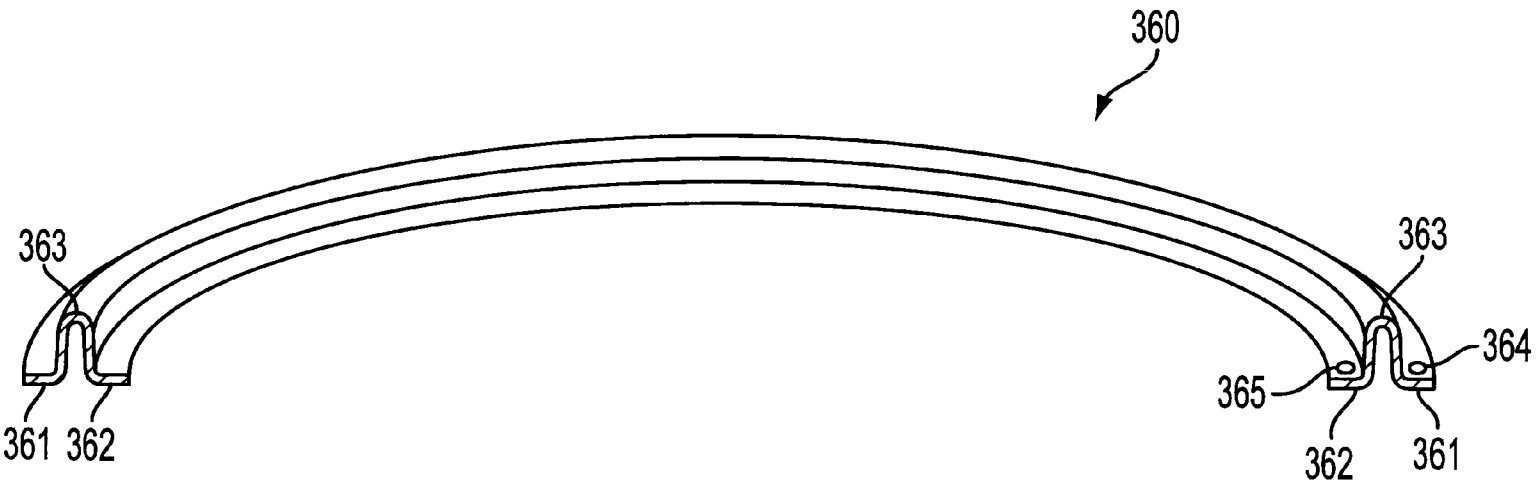
FIG. 14 is a diagrammatic illustration showing an embodiment of the subcarrier assembly suspension member.

A detailed portion of the inventive CMP head is illustrated in FIG. 13 which shows, among other features, the exemplary structure of the subcarrier assembly suspension element 360. This element is also illustrated in FIG. 14 in a perspective and partial half-sectional view. In particular, it shows element 360 having a mid-portion 363 in the form of an annular a loop or channel portion, and outer and inner radial edge portions 361, 362. Annular channel 363 which in cross-section appears in the form of a curved loop provides relatively frictionless vertical movement of the subcarrier assembly relative to the housing 304 and retaining ring assembly 320. Furthermore, this type of suspension element 360 desirably decouples movement of the retaining ring assembly 320 and of the subcarrier assembly 350 so that the movements are independent, again, except for negligible frictional interference that may occur at sliding surfaces. Suspension element 360 may also be formed from EPDM also known as EPR which is a general purpose rubber material with excellent chemical resistance and dynamic properties. One variant of EPDM has a tensile strength of 800 psi and a nominal durometer of between 55 and 65.

An upper surface 380 of membrane backing plate 352 is attached to a lower surface 381 of subcarrier support plate 351 by screws 353 or other fasteners. In one embodiment, a lower or outer surface 382 of the backing plate (the surface facing the membrane 350) includes a recess or cavity 383 such that when the membrane 350 is attached to the membrane backing plate 352, and the membrane only contacts the backing plate at the outer radial peripheral portion near the edge of the backing plate. In embodiment of FIG. 10, the separation or cavity 383 between the membrane 350 and the membrane backing plate defines a chamber into which pneumatic or air pressure (positive pressure and negative pressure or vacuum) may be introduced to effect the desired operation of the head.

Figure 16:
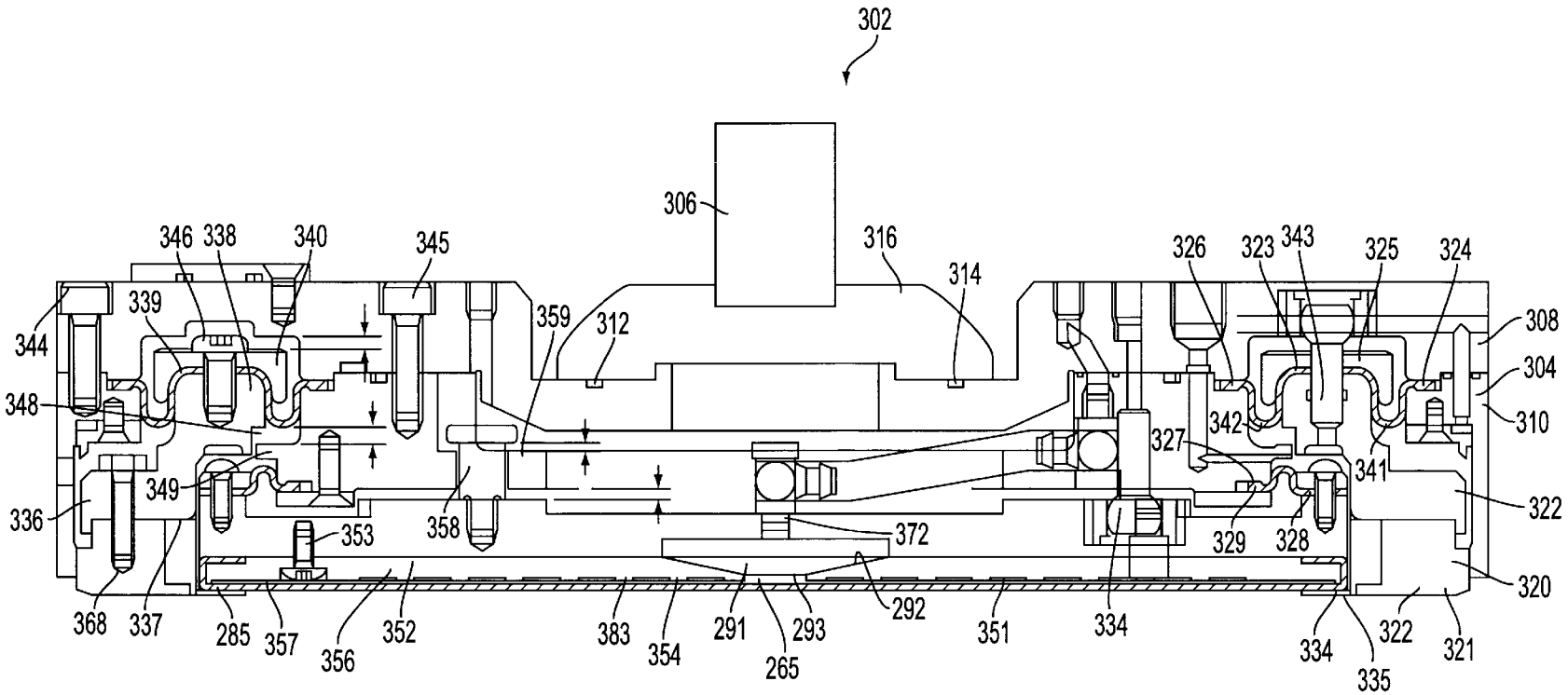
FIG. 16 is a diagrammatic illustration showing an alternative preferred embodiment of the inventive head having a membrane with an orifice.
Figure 17A:
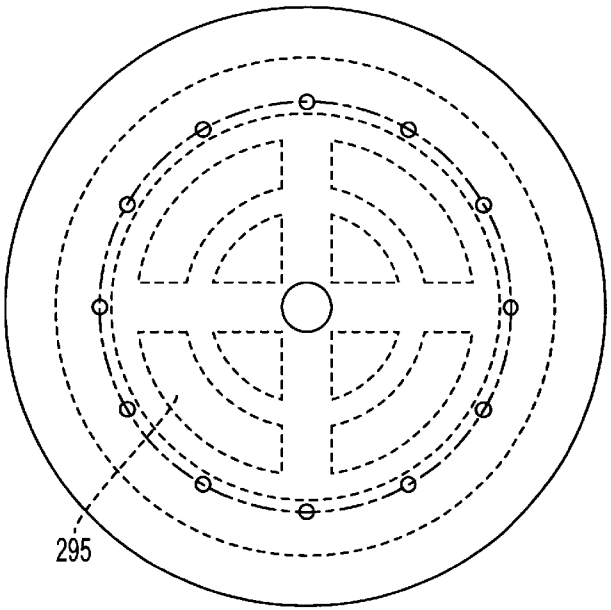
FIG. 17 is a diagrammatic illustration showing an embodiment of a membrane backing plate that may be used with the embodiment of FIG. 16.
Figure 17C:
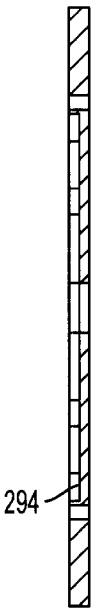
Figure 17B:
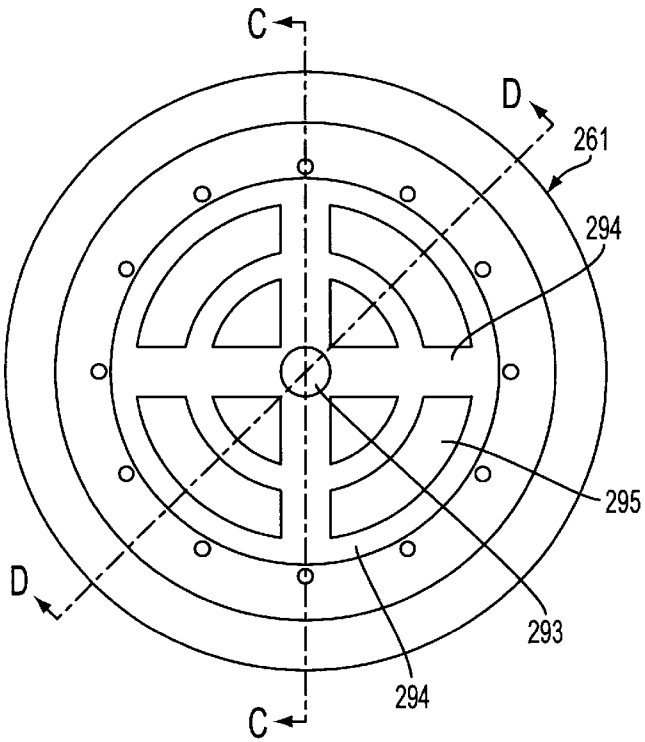
Figure 17D:
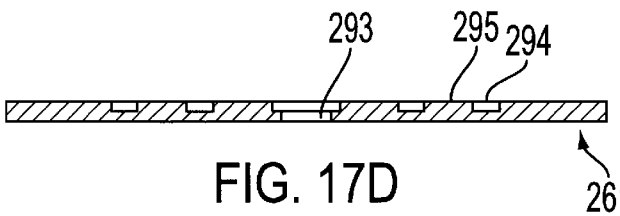

In an alternative embodiment to be described relative to FIG. 16, the membrane includes at least one hole or orifice 265 so that no enclosure or chamber is defined, rather pressure is applied to the wafer backside directly. The membrane 350 in the latter embodiment being used to limit contamination of slurry into the head and to assist in sealing or partially sealing the wafer to the head.

Recall that in the descriptions of the simplified FIG. 3 and FIG. 4 embodiments, either a corner portion 260 having predetermined material properties, a membrane backing plate 261 having a recess 279, or a thickened portion 263 of the membrane itself where used to provide the desired transmission of force from the subcarrier proximate the peripheral edge. A similar result is provided by the membrane backing plate 351 alone or in conjunction with the membrane 250 which is advantageously stretched across the membrane backing plate 252 (somewhat in the manner of a drum skin over a cylindrical frame) and attached by utilizing the membrane backing plate 351 and the lower surface of the subcarrier support plate as clamping elements.

In one embodiment, membrane 250 is molded from EPDM or other rubber-like material; however other materials may be used. For example, silicon rubber may be used as well but may occasionally stick to the silicon wafers in some environments. The membrane material should generally have a durometer of between about 20 and about 80, more typically between about 30 and about 50, and usually from about 35 to about 45, with a durometer of 40 giving the best results in many instances. Durometer is a measure of hardness for polymeric materials. A lower durometer represents a softer material than a higher durometer material. The material should be resilient and have good chemical resistence as well as other physical and chemical properties consistent with operation in a CMP planarization environment.

In one embodiment, membrane 250, 350 is made from about 0% to about 5% smaller in diameter, more usually between about 2% and about 3% smaller in diameter, than the desired installed size and stretched to the full size (100%) during installation, especially for lower durometer materials. The membrane as manufactured is therefore smaller than the diameter when installed so that it is stretched and taught when installed.

Figure 15C:
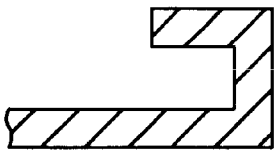
FIG. 15 is a diagrammatic illustration showing an embodiment of the wafer backside membrane.
Figure 15A:
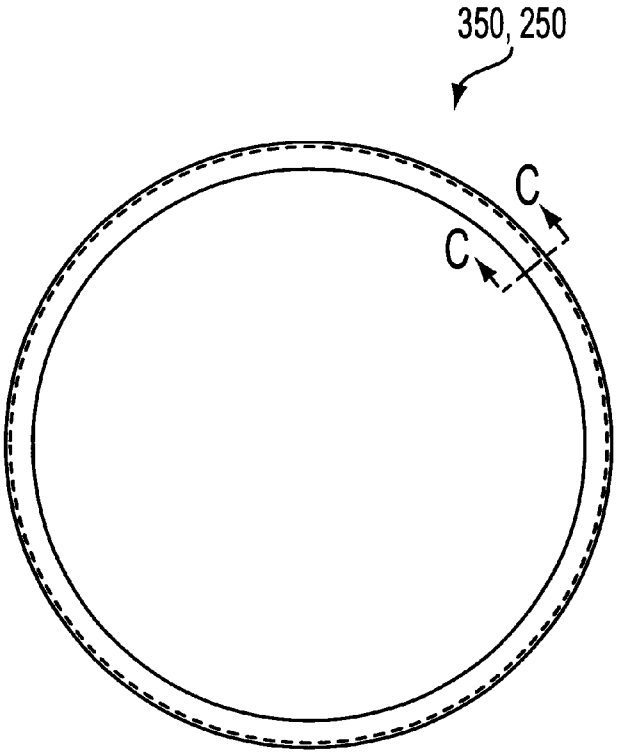
Figure 15B:
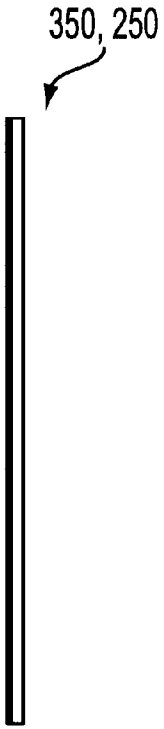

One embodiment of circular membrane 250 is illustrated in FIG. 15. Membrane 250 has a nominal thickness as fabricated of between about 0.2 mm and about 2 mm, more usually between about 0.5 mm and about 1.5 mm, and in one particular embodiment a thickness of about 1 mm. These dimensions are for the central portion of a constant thickness membrane and do not include thickened portions at or near its peripheral edge of some embodiments as described herein above. The membrane fits over either the corner ring or the outer edge of the membrane backing plate 261, depending upon the particular implementation.

The amount of the membrane that actually touches the wafer backside may vary depending upon the edge exclusion requirements, the uniformity of the incoming wafers, the polishing non-uniformity of the CMP process if operated without differential edge pressure, and other factors. In typical situations, the amount of membrane that is in contact with the wafer backside will vary between about 0.5 mm and about 20 mm, more typically between about 1 mm and about 10 mm, and usually between about 1 mm and about 5 mm. However, these ranges arise from the need to correct process non-uniformity and neither the inventive structure nor method are limited to these ranges. For example, if there were reason to provide direct subcarrier pressure to the outer 50 mm region of the wafer, the inventive structure and method may readily be adapted for that situation.

In embodiments of the inventive head that utilize the annular or ring shaped corner insert to transmit subcarrier pressure to the edge of the wafer, the membrane may have substantially uniform wall thickness on the bottom and side wall portions. However, when the thickened membrane side wall itself is used as the force transmission means, then the side wall thickness should be commensurate with the distance over which the subcarrier force is to be directly applied to the wafer. In simple terms, if it is desired that the subcarrier force be applied to the outer 3 mm of the wafer then the membrane side wall thickness should be 3 mm. It will also be appreciated that there may not be a precise one-to-one relationship between the desired area or zone over which the subcarrier force is to be applied and the thickness of the membrane side wall. Some transition in the force or pressure transmission between the adjacent areas may be expected and indeed may even be desirable in some circumstances to avoid an abrupt pressure discontinuity. Also, it may sometimes, though not always, be desirable to provide a membrane side wall thickness somewhat less or somewhat more than the distance over which the subcarrier force is to be applied to provide a desired pressure transition between subcarrier pressure and wafer backside pressure. For example, in some instances for a nominal 3 mm wafer outer peripheral zone over which direct subcarrier pressure is to be applied, the membrane side wall thickness may be in the range of between about 2 mm and about 4 mm. It will be understood that these particular numerical values are exemplary only and that the best dimensions will depend on such factors as membrane material, planarization pressures, polishing pad characteristics, type of slurry, and so forth, and will generally be determined empirically while developing the CMP machine and process.

In a general sense, and without benefit of theory, when $F_{SC}>F_{BS}$, the subcarrier pressure ($F_{SC}$) overrides pressure at the edge of the wafer so that the wafer edge sees subcarrier pressure ($F_{SC}$) and the central portion of the wafer sees the backside pressure ($F_{BS}$). When $F_{SC}<F_{BS}$, the backside membrane pressure ($F_{BS}$) may dominate the subcarrier pressure ($F_{SC}$) when it is great enough. However, typically the CMP head will be operated with $F_{SC}<F_{BS}$ so that removal of material at the peripheral edge of the wafer is diminished relative to the amount of material removed in the central portion. The relative pressures, diameters, and material properties are adjusted to achieve the desired planarization results.

Attention is now directed to a description of the pressure zones, pressure chambers, and pressures applied to different portions of the system. By way of summary, a retaining ring pressure is applied to the urge the lower wear surface of the retaining ring against the polishing pad, sub-carrier pressure applied at the outer radial peripheral edge of the wafer, and backside wafer pressure (or vacuum) applied against the central back side portion of the wafer. One further pressurized line or chamber is advantageously used for a head flush to flush polishing slurry and debris that might otherwise migrate into the head away. One or more additional zone of pressure may optionally be applied to a central circular region of the wafer backside or to annular regions intermediate between the central region and the outer peripheral region of the wafer backside. Embodiments utilizing such inflatable generally annular tube or ring shaped bladder are described elsewhere herein as have rotary unions for communicating the pressurized fluids to these and other areas of the head.

In the embodiment just described, backside pressure chamber 354 is defined generally between membrane backing plate 352 outer surface 355 and an inner surface 356 of membrane 350.

Attention is now directed to an embodiment of the invention in FIG. 16, having a membrane with orifice analogous to that already described relative to FIG. 4. A membrane pressure hole or orifice is provided in the membrane 250 so that backside pressure is applied directly against the wafer without the membrane necessarily touching the wafer backside surface except near the outer peripheral edge of the wafer where direct subearrier pressure is to be applied. In this embodiment, any membrane overlying the central portion of the wafer during polishing is used primarily to form a pressure/vacuum seal. That is, when the wafer is being held against the head during wafer loading and unloading operations. The size of the membrane orifice may vary from a few millimeters to a diameter that extends nearly to the outer diameter of the subcarrier plate.

As described relative to the FIG. 4 embodiment, a reservoir prevents polishing slurry from being sucked up into the pressure/vacuum line during wafer loading. Sloping the edges of the reservoir facilitates drainage of the slurry back out of the head. Note that it is expected that the amount of slurry that is sucked into the reservoir is expected to be small so that only occasional cleaning is required. Such cleaning may be accomplished manually, or by injecting a stream or pressurized air, water, or a combination of air and water to clear the line and the reservoir.

The presence of the membrane orifice somewhat complicates the communication of vacuum to the wafer backside as well as complicating sensing of proper wafer mounting when the sensing is accomplished by sensing for vacuum pressure build up. When the recess in the membrane backing plate is thin, pulling a vacuum from a central pressure line may result in sealing the membrane against the backing plate centrally but not communicating the vacuum to other regions of the wafer. The membrane itself does not exert the pull as it would were there no orifice. On the other hand, this problem might be remedied by increasing the thickness or the membrane backing plate recess or by using the corner insert or thickened membrane edge embodiments; however, this reduces the support available to the wafer.

Figure 18:
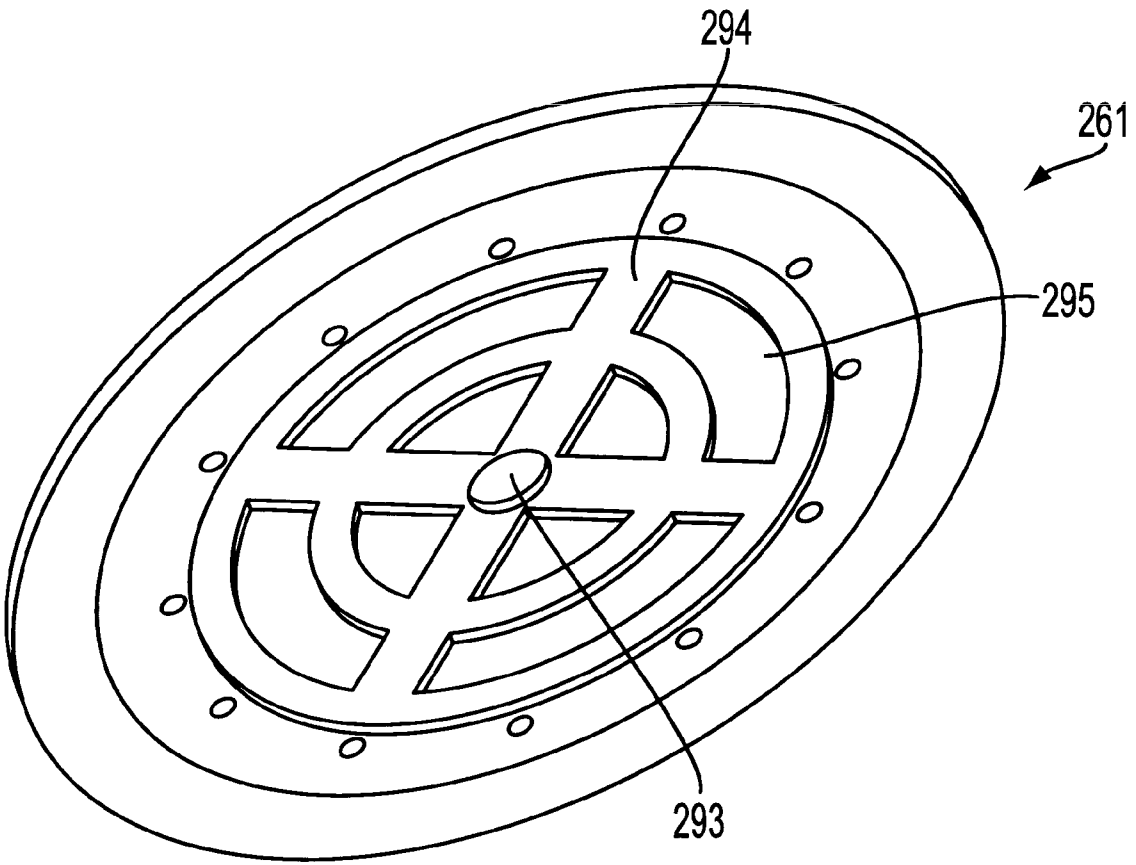
FIG. 18 is a diagrammatic illustration showing a perspective view of the membrane backing plate of FIG. 17.

A better solution is provided by an embodiment of the membrane backing plate illustrated in FIG. 17 and FIG. 18, where FIG. 18 is a perspective illustration of the plate illustrated in FIG. 17. The additional support is desirable to prevent flexing, bowing, or wrapping of the wafer. Although the wafer substrate itself may not typically permanently deform, crack, or otherwise be damaged; the metal, oxide, and/or other structures and lines on the front side of the wafer may crack if subjected to stress. Hence, sufficient support is desirably provided to the backside, particularly when the wafer is pulled up against the diaphragm during loading before polishing and after polishing before removal of the wafer.

One or more orifices or holes are provided near the outer edge of the membrane backing plate. These serve as bolt holes to attach the membrane backing plate to the subcarrier plate while clamping the membrane between them. First and second radial channels extend from a central orifice that is coupled for communication with an external pressure/vacuum source that provides the backside pressure during polishing as well as communicating a vacuum during wafer mounting before and after polishing. First and second concentric annular channels intersect the radial channels. The effect is to communicate pressure and vacuum to the wafer and yet provide a desired support for the wafer.

The physical structure of the head also facilitates easy access for removing the membrane 250 from the sub-carrier support plate from the outside of the head without any need to disassemble the head as in many conventional head structures. Recall that the bolt holes in the membrane backing plate secure the membrane to the subcarrier plate and are accessible from the exterior of the head. One or a set of holes are used to check vacuum and wafer presence or positioning, and another set of holes are used to access screws or other fasteners that attach the membrane to the head. As the membrane is a wear item, it will occasionally need to be replaced, so the ability to replace it from the exterior of the head without requiring disassembly of the head is advantageous.

All publications, patents, and patent applications mentioned in this specification are herein incorporated by reference to the same extent as if each individual publication or patent application was specifically and individually indicated to be incorporated by reference.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best use the invention and various embodiments with various modifications as are suited to the particular use contemplated. It is intended that the scope of the invention be defined by the claims appended hereto and their equivalents.

We claim:

1. A polishing apparatus for polishing a surface of a substrate, comprising:

a rotatable polishing pad; and a substrate subcarrier including:

a substrate receiving portion to receive the substrate and to position the substrate against the polishing pad; and a substrate pressing member including:

a flexible member connected to said subcarrier such that the bottom surface of said flexible member is capable of contacting said substrate when in operation;

an annular member mechanically coupling a peripheral portion of said flexible member to said substrate subcarrier such that a first force applied to said subcarrier during operation results in a first pressure exerted against said substrate in contact with said peripheral portion of said flexible member;

a second pressing member applying a second pressure to a central portion of said flexible member, thereby applying a second pressure to said substrate when in operation; and wherein said second pressing member comprises a plurality of substantially concentric pressing members each applying a loading pressure at a local region of said substrate against said polishing pad.

2. A polishing apparatus as in claims 1, wherein each of said plurality substantially concentric pressing members comprise a pressure chamber defined on at least one portion by a resilient surface, said resilient surface being pressed against said flexible member, and said flexible member being pressed against said substrate during operation to provide said loading when a pressurized gas is introduced into said chamber.

3. A polishing apparatus as in claim 2, wherein said flexible member defines a surface portion of an outer pressure chamber receiving a pressure from an external source of pressurized gas and exerting a loading force of said substrate against said polishing pad.

4. A polishing apparatus as in claim 2, wherein said flexible member defines a surface portion of an outer pressure chamber receiving a pressure from an external source of pressurized gas and exerting a loading force of said substrate against said polishing pad; and each of said plurality of substantially concentric pressing members are contained within said outer pressure chamber.

5. A polishing apparatus as in claim 4, wherein said loading pressures exerted by said outer pressure chamber is separately additive with the loading pressure of one of said plurality of pressing members, so that the loading pressure at different zones may be separately adjustable and said outer pressure chamber minimizes pressure discontinuities across pressure zone boundaries.

6. A polishing apparatus as in claim 1, wherein at least one of said plurality of substantially concentric pressing members comprise a substantially annular member exerting a loading pressure against a substantially annular region of said substrate.

7. A polishing apparatus as in claim 1, wherein one of said plurality of substantially concentric pressing members comprise a substantially circular member exerting a loading pressure against a substantially circular region of said substrate.

8. A polishing apparatus as in claim 1, wherein at least one of said plurality of substantially concentric pressing members comprise a substantially annular member exerting a loading pressure against a substantially annular region of said substrate; and one of said plurality of substantially concentric pressing members comprise a substantially circular member exerting a loading pressure against a substantially circular region of said substrate.

9. A polishing apparatus as in claim 1, wherein said membrane is selected from the group of materials consisting of EPDM, EPR, and rubber.

10. A polishing apparatus for polishing a surface of a substrate, comprising:

a rotatable polishing pad; and a substrate subcarrier including:

a substrate receiving portion to receive the substrate and to position the substrate against the polishing pad; and a substrate pressing member including:

a flexible member connected to said subcarrier such that the bottom surface of said flexible member is capable of contacting said substrate when in operation;

an annular member mechanically coupling a peripheral portion of said flexible member to said substrate subcarrier such that a first force applied to said subcarrier during operation results in a first pressure exerted against said substrate in contact with said peripheral portion of said flexible member;

a second pressing member applying a second pressure to a central portion of said flexible member, thereby applying a second pressure to said substrate when in operation; and wherein said second pressing member comprises a plurality of substantially concentric pressing members each applying a loading pressure at a local region of said substrate against said polishing pad;

each of said plurality of substantially concentric pressing members comprise a pressure chamber defined on at least one portion by a resilient surface, said resilient surface being pressed against said flexible member and said flexible member being pressed against said substrate during operation to provide said loading when a pressurized gas is introduced into said chamber;

said flexible member defines a surface portion of an outer pressure chamber receiving a pressure from an external source of pressurized gas and exerting a loading force of said substrate against said polishing pad; and each of said plurality of substantially concentric pressing members are contained within said outer pressure chamber;

said loading pressures exerted by said outer pressure chamber is separately additive with the loading pressure of one of said plurality of pressing members, so that the loading pressure at different zones may be separately adjustable and said outer pressure chamber minimizes pressure discontinuities across pressure zone boundaries;

said substrate is selected from the group of substrates consisting of a semiconductor wafer, glass, a liquid crystal display (LCD) panel, a plated surface, a coated surface, and combinations thereof; and said resilient surface and said membrane are each formed from a material selected from the group of materials consisting of EPDM, EPR, and rubber.

11. A substrate subcarrier for polishing a substrate against a polishing pad in a CMP tool, said subcarrier comprising:

a substrate receiving portion to receive said substrate;

a flexible member connected to said subcarrier such that the bottom surface of said flexible member is capable of contacting said substrate when in operation; and an annular member mechanically coupling a peripheral portion of said flexible member to said substrate subcarrier such that a first force applied to said subcarrier during operation results in a first pressure exerted against said substrate in contact with said peripheral portion of said flexible member;

a second pressing member applying a second pressure to a central portion of said flexible member, thereby applying a second pressure to said substrate when in operation; and wherein said second pressing member comprises a plurality of substantially concentric pressing members each applying a loading pressure at a local region of said substrate against said polishing pad.

12. A polishing apparatus as in claim 11, wherein each of said plurality of substantially concentric pressing members comprise a pressure chamber defined on at least one portion by a resilient surface, said resilient surface being pressed against said flexible member and said flexible member being pressed against said substrate during operation to provide said loading when a pressurized gas is introduced into said chamber.

13. A polishing apparatus for polishing a surface of a substrate, comprising:

a rotatable polishing pad; and a substrate subcarrier including:

a substrate receiving portion to receive the substrate and to position the substrate against the polishing pad;

a flexible member connected to said subcarrier such that the bottom surface of said flexible member is capable of contacting said substrate when in operation;

an annular member mechanically coupling a peripheral portion of said flexible member to said substrate subcarrier such that a first force applied to said subcarrier during operation results in a first pressure exerted against said substrate in contact with said peripheral portion of said flexible member; and wherein said flexible member is a membrane having at least one orifice.

14. A substrate subcarrier for polishing a substrate against a polishing pad in a CMP tool, said subcarrier comprising:

a substrate receiving portion to receive said substrate;

a flexible member connected to said subcarrier such that the bottom surface of said flexible member is capable of contacting said substrate when in operation; and can annular member mechanically coupling a peripheral portion of said flexible member to said substrate subcarrier such that a first force applied to said subcarrier during operation results in a first pressure exerted against said substrate in contact with said peripheral portion of said flexible member;

a second pressing member applying a second pressure to a central portion of said flexible member, thereby applying a second pressure to said substrate when in operation; and wherein said flexible member is a membrane having at least one orifice.

15. A polishing apparatus for polishing a surface of a substrate, comprising:

a rotatable polishing pad; and a substrate subcarrier including:

a substrate receiving portion to receive the, substrate and to position the substrate against the polishing pad;

a membrane with at least one orifice connected to said subcarrier such that the bottom surface of said membrane is capable of contacting said substrate when in operation; and an annular rigid corner ring piece mechanically coupling a peripheral plortion of said membrane to said substrate subcarrier such that a first force applied to said subcarrier during operation results in a first pressure exerted against said substrate in contact with said peripheral portion of said membrane.

16. A method for planarizing a substrate; said method comprising:

applying a first force to a substrate subcarrier such that the bottom surface of a flexible member connected to said subcarrier contacts said substrate, and a first pressure is exerted pressing a portion of said substrate in contact with a peripheral portion of said flexible member against a polishing pad; and applying a second pressure to a central portion of said flexible member such that a second pressure is applied to said substrate, wherein said second pressure is applied with a pressing member comprising a plurality of substantially concentric pressing members each applying a loading pressure at a local region of said substrate against a polishing pad.

17. A method for planarizing a substrate as in claim 16, wherein each of said plurality of substantially concentric pressing members comprise a pressure chamber defined on at least one portion by a resilient surface, said method further comprising:

pressing said resilient surface against said flexible member; and pressing said flexible member against said substrate.

18. A method for planarizing a substrate as in claim 17, wherein said flexible member defines a surface portion of an outer pressure chamber, said method further comprising:

applying a pressure to said outer pressure chamber from an external source of pressurized fluid, thereby exerting a loading force of said substrate against said polishing pad.

19. A method for planarizing a substrate as in claim 17, wherein said flexible member defines a surface portion of an outer pressure chamber, said method further comprising:

applying a pressure to said outer pressure chamber from an external source of pressurized fluid, thereby exerting a loading force on said substrate against said polishing pad, and wherein each of said plurality of substantially concentric pressing members are contained within said outer pressure chamber.

20. A method for planarizing a substrate as in claim 19, wherein said loading pressure exerted by said outer pressure chamber is separately additive with the loading pressure of one of said plurality of pressing members, said method further comprising:

separately adjusting loading pressures at different zones; and substantially minimizing pressure discontinuities across pressure zone boundaries.

21. A method for planarizing a substrate as in claim 16, wherein at least one of said plurality of substantially concentric pressing members comprise a substantially annular member, said method further comprising:

applying a loading pressure against a substantially annular region of said substrate through said substantially annular member.

22. A method for planarizing a substrate as in claim 16, wherein at least one of said plurality of substantially concentric pressing members comprises a substantially circular member, said method further comprising:

applying a loading pressure against a substantially circular region of said substrate through said substantially circular member.

23. A method for planarizing a substrate as in claim 16, wherein at least one of said plurality of substantially concentric pressing members comprises a substanitially annular member and one of said plurality of substantially concentric pressing members comprises a substantially circular member, said method further comprising:

applying a loading pressure against a substantially annular region of said substrate through said substantially annular member; and applying a loading pressure against a substantially circular region of said substrate through said substantially circular member.

24. A method for planarizing a substrate comprising:

contacting said substrate with a flexible member connected to a substrate subcarrier, wherein a peripheral portion of said flexible member is mechanically coupled to said substrate subcarrier by an annular member;

applying a first force to said subcarrier such that a first pressure is exerted against a portion of said substrate in contact with said peripheral portion of said flexible member;

applying a plurality of loading pressures, each at a local region of said substrate, with a plurality of substantially concentric pressing members.

25. A method for planarizing a substrate comprising:

positioning said substrate against a polishing pad;

contacting said substrate with a membrane having at least one orifice connected to a substrate subcarrier, wherein a peripheral portion of said membrane is mechanically coupled to said substrate subcarrier with an annular member;

applying a first force to said subcarrier, thereby exerting a first pressure against a portion of said substrate in contact with said peripheral portion of said membrane.

26. A semiconductor wafer polished according to claim 16.

27. A semiconductor wafer polished according to claim 24.

* * * * *